US008878642B2

(12) United States Patent
Ueno et al.

(10) Patent No.: US 8,878,642 B2
(45) Date of Patent: Nov. 4, 2014

(54) DUST CORE AND METHOD FOR PRODUCING THE SAME

(75) Inventors: Tomoyuki Ueno, Itami (JP); Takao Nishioka, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 69 days.

(21) Appl. No.: 13/502,985

(22) PCT Filed: May 16, 2011

(86) PCT No.: PCT/JP2011/061243

§ 371 (c)(1), (2), (4) Date: Apr. 19, 2012

(87) PCT Pub. No.: WO2011/145582

PCT Pub. Date: Nov. 24, 2011

(65) Prior Publication Data

US 2012/0229244 A1 Sep. 13, 2012

(30) Foreign Application Priority Data

May 19, 2010 (JP) ..... 2010-115224

(51) Int. Cl.
*H01F 27/24* (2006.01)

(52) U.S. Cl.
USPC ..... 336/233

(58) Field of Classification Search
USPC ..... 336/83, 233–234, 96, 220–223
See application file for complete search history.

(56) References Cited

U.S. PATENT DOCUMENTS

2010/0097171 A1* 4/2010 Urata et al. ..... 336/233

FOREIGN PATENT DOCUMENTS

| | | | |
|---|---|---|---|
| CN | 101107681 A | | 1/2008 |
| CN | 101258659 A | | 9/2008 |
| JP | 60-12713 A | | 1/1985 |
| JP | 01-188266 A | | 7/1989 |
| JP | 2002-224916 A | | 8/2002 |
| JP | 2002235865 A | * | 8/2002 |

(Continued)

OTHER PUBLICATIONS

International Search Report for PCT/JP2011/061243, dated Aug. 16, 2011, p. 1.

(Continued)

*Primary Examiner* — Tuyen Nguyen
(74) *Attorney, Agent, or Firm* — Ditthavong & Steiner, P.C.

(57) ABSTRACT

There are provided a dust core in which, even if the surface of a heat-treated compact is ground, the insulation between soft magnetic particles on the ground surface can be ensured in the grinding step, and a method for producing the dust core.

The method includes a preparation step of preparing a heat-treated compact 100 by compacting soft magnetic particles having an insulation coating and heating the resultant compact to a predetermined temperature; and a machining step of removing part of the heat-treated compact 100 using a working tool 2. The machining step is performed while an electric current is supplied with a conductive fluid 7L between the heat-treated compact 100 serving as an anode and a working tool 2 that machines the heat-treated compact 100 or a first counter electrode 5 that faces the working tool 2 with a distance therebetween, the working tool 2 or the first counter electrode 5 serving as a cathode. A bridge portion that connects soft magnetic particles to each other is removed through the supply of an electric current, the soft magnetic particles being adjacent to each other along a machined surface of the heat-treated compact 100.

8 Claims, 13 Drawing Sheets

(56) References Cited

FOREIGN PATENT DOCUMENTS

| | | | |
|---|---|---|---|
| JP | 2005-317678 | A | 11/2005 |
| JP | 2006-202956 | A | 8/2006 |
| JP | 2009-283774 | A | 12/2009 |
| WO | WO 2011/145582 | A1 | 11/2011 |

OTHER PUBLICATIONS

Notification of First Office Action for corresponding Chinese Patent Application No. 201180004257.9, dated Jul. 21, 2014, 22 pages.

* cited by examiner

DUST CORE AND METHOD FOR PRODUCING THE SAME

TECHNICAL FIELD

The present invention relates to a dust core used for electrical appliances equipped with solenoid valves, motors, or power supply circuits and a method for producing the dust core, and a coil component. In particular, the present invention relates to a dust core in which the insulation between soft magnetic particles on a ground surface can be properly ensured while performing grinding.

BACKGROUND ART

When a core is used in an alternating magnetic field, a loss of energy called iron loss occurs. This iron loss is expressed by the sum of hysteresis loss and eddy-current loss. To reduce hysteresis loss, the coercive force Hc of the core may be reduced. To reduce eddy-current loss, the electrical resistivity ρ of the core may be increased. In particular, in the use of the core at high frequency, eddy-current loss is significantly increased.

Dust cores disclosed in PTLs 1 and 2 are known as dust cores that can reduce the iron loss. The dust cores are formed by compacting composite magnetic particles that are obtained by forming an insulation coating on a surface of each of soft magnetic particles. Since the soft magnetic particles are insulated from each other by the insulation coating, the dust cores produce a high effect of reducing eddy-current loss.

Such a dust core is produced through a forming step of obtaining a compact using a mold including a die and a punch and a heat-treating step of performing a heat treatment on the compact to obtain a heat-treated compact. However, the shape of the compact obtained using the mold is limited to somewhat a simple shape, and furthermore it is difficult to stably maintain high dimensional accuracy. Therefore, the shape of a dust core obtained is sometimes adjusted by performing machining such as grinding on the heat-treated compact.

CITATION LIST

Patent Literature

PTL 1: Japanese Unexamined Patent Application Publication No. 2006-202956

PTL 2: Japanese Unexamined Patent Application Publication No. 2009-283774

SUMMARY OF INVENTION

Technical Problem

However, when the heat-treated compact is subjected to grinding, a portion that is not coated with an insulation coating is generated on the ground surface of the dust core. In particular, as shown in FIG. 2(D), soft magnetic particles 110 that are adjacent to each other among soft magnetic particles 110 on a ground surface may be deformed by working stress during grinding and thus electrically connected to each other through a bridge portion 110B that crosses the ground surface of an insulation coating 120. Such electrical connection increases the eddy-current loss of the dust core. A treatment for eliminating the electrical connection can be performed on the ground surface after the grinding, but it is extremely difficult to selectively divide the bridge portion generated in part of the fine soft magnetic particles. In addition, the formation of an insulation coating on the ground surface again increases the number of production processes.

In view of the foregoing, an object of the present invention is to provide a dust core in which even if the dust core has a ground surface, soft magnetic particles on the ground surface are properly insulated from each other.

Another object of the present invention is to provide a method for producing a dust core in which even if the surface of the dust core is ground, the insulation between soft magnetic particles on the ground surface can be ensured in the grinding step.

Solution to Problem

The inventors of the present invention have attempted to, when machining such as grinding is performed on a heat-treated compact, remove a bridge portion of soft magnetic particles adjacent to each other in the process of machining or form an insulation layer on the surface of soft magnetic particles exposed from an insulation coating due to the machining. In the process of the attempt, they have focused on ELID (electrolytic in-process dressing) grinding.

ELID grinding is a technology that grinds a workpiece by supplying an electric current while providing a conductive grinding fluid between a conductive grinding wheel serving as an anode and a counter electrode serving as a cathode, the counter electrode facing the grinding wheel with a certain distance therebetween (e.g., refer to Japanese Unexamined Patent Application Publication No. 1-188266). In this technology, a bond of the grinding wheel is selectively eluted through electrolysis, and part of abrasive grains is exposed from the bond to create a state in which the grinding wheel is dressed. Herein, part of the constituent element of the eluted bond is oxidized and deposited on the surface of the grinding wheel in the form of a nonconductive film. After the formation of the nonconductive film proceeds to some extent, the electrolytic current is decreased and the electrolysis of the bond is also suppressed. When grinding is performed in this state, the nonconductive film on the surface of the grinding wheel is worn and detached through the contact with the workpiece, and is gradually removed. At the same time, the abrasive grains grind the workpiece. When the insulation between the bond of the grinding wheel and the counter electrode is decreased due to the fact that the nonconductive film is removed to some extent, the electrolysis of the bond is restarted. In other words, by repeating the cycle of selective electrolysis of bond→formation of nonconductive film→removal of nonconductive film due to grinding→another selective electrolysis of bond, grinding can be performed while dressing is conducted. Thus, high-precision processing can be continued while the clogging of the grinding wheel is suppressed.

The inventors of the present invention have paid attention to the fact that, in the process of ELID grinding, a bond in the anode is eluted through electrolysis, and the eluted element is oxidized and thus a nonconductive film is formed. That is, the inventors have considered as follows. In the grinding of a compact, if a constituent element of soft magnetic particles is eluted through electrolysis and an oxide film (hydroxide film) of the eluted element is formed, a bridge portion that is easily generated on a machined surface of a dust core subjected to machining can be removed and an insulation film can be formed on the machined surface. The inventors have found that, by applying the technology of ELID (electrolytic in-process dressing) grinding that can continuously perform grinding with high precision while a grinding wheel is dressed and by properly selecting components to be an anode and a cathode, the bridge portion can be removed and the insulation layer can be formed in the process of machining. Thus, the present invention has been completed.

[Method for Producing Dust Core]

A method for producing a dust core according to the present invention includes the following steps.

Preparation step: A heat-treated compact is prepared by compacting soft magnetic particles having an insulation coating and heating the resultant compact to a predetermined temperature.

Machining step: Part of the heat-treated compact is removed using a working tool while an electric current is supplied with a conductive fluid between the heat-treated compact serving as an anode and a working tool that machines the heat-treated compact or a first counter electrode that faces the working tool with a distance therebetween, the working tool or the first counter electrode serving as a cathode.

The machining step includes a removal step of removing a bridge portion that connects soft magnetic particles to each other, the soft magnetic particles being adjacent to each other along a machined surface of the heat-treated compact.

In typical ELID grinding, a grinding wheel is used as an anode to electrolyze a bond of the grinding wheel. In the method for producing a dust core according to the present invention, an electric current is supplied using the heat-treated compact as an anode and the working tool such as a grinding wheel or the first counter electrode as a cathode. This can generate at least one of electrical discharge between the heat-treated compact and the working tool and the electrolysis that elutes a constituent element of soft magnetic particles. It is believed that such electrical discharge or electrolysis can remove the bridge portion. As a result, when the dust core produced by this method is used for various coil components, an increase in the eddy-current loss caused by electrical connection between the soft magnetic particles can be suppressed.

In one aspect of the method for producing a dust core according to the present invention, the working tool is a grinding wheel, a cutting tool, a polishing tool, or a chopping tool.

With any of the tools, a dust core having a high degree of freedom in shape can be produced by mechanically removing part of the heat-treated compact.

In one aspect of the method for producing a dust core according to the present invention, the method further includes, after the machining step, a coating step of forming, on the machined surface, an insulation layer containing at least one of an oxide and a hydroxide of a constituent element of the soft magnetic particles by supplying an electric current while providing a conductive fluid between the working tool and the heat-treated compact disposed with a distance therebetween.

The constituent element of the soft magnetic particles eluted through electrolysis is oxidized (hydroxylated) and an insulation layer is formed on the machined surface. Thus, an insulation layer having a function equal to that of the insulation coating can be formed on the machined surface where an insulation coating has been removed by machining, and the exposure of the soft magnetic particles can be suppressed. As a result, when the produced dust core is used for various coil components, an increase in the eddy-current loss caused by electrical connection between the soft magnetic particles can be suppressed.

In one aspect of the method for producing a dust core according to the present invention, in the coating step, the distance between the working tool and the heat-treated compact is kept constant by relatively moving the working tool and the heat-treated compact.

The distance between the working tool and the heat-treated compact is kept constant, whereby the electrolysis of soft magnetic particles is stably caused between the working tool and the heat-treated compact and an insulation layer can be uniformly formed.

In one aspect of the method for producing a dust core according to the present invention, the method further includes a re-insulation coating step of causing a second counter electrode to face a portion where the insulation coating has come off with a distance therebetween, the portion being present on an outer peripheral surface of the heat-treated compact other than the machined surface, and supplying an electric current while providing a conductive fluid between the heat-treated compact serving as an anode and the second counter electrode serving as a cathode so that an insulation layer containing at least one of an oxide and a hydroxide of a constituent element of the soft magnetic particles is formed in the portion.

When soft magnetic particles having an insulation coating is compacted or a compact is drawn from a mold, the insulation coating formed on the soft magnetic particles may be damaged. When a portion where an insulation coating is damaged is present on a surface other than the machined surface, by forming an insulation layer in the damaged portion, the portion can be recovered to a state that is equivalent to the state in which the insulation coating has been repaired. Thus, when the produced dust core is used for various coil components, an increase in the eddy-current loss caused by electrical connection between the soft magnetic particles can be suppressed.

In one aspect of the method for producing a dust core according to the present invention, in the re-insulation coating step, the distance between the heat-treated compact and the second counter electrode is kept constant by relatively moving the heat-treated compact and the second counter electrode.

The distance between the heat-treated compact and the second counter electrode is kept constant, whereby the electrolysis of soft magnetic particles is stably caused between the heat-treated compact and the second counter electrode and an insulation layer can be uniformly formed.

In one aspect of the method for producing a dust core according to the present invention, in the re-insulation coating step, the conductive fluid is supplied from a nozzle and the nozzle serves as the second counter electrode.

In this configuration, since the nozzle serves as the second counter electrode, an apparatus configuration required to perform the re-insulation coating step can be simplified.

In one aspect of the method for producing a dust core according to the present invention, the working tool contains at least one element selected from Al, Si, Ti, Mg, Ca, Cr, Zr, P, and B.

In this configuration, a certain additional element contained in the working tool is diffused into soft magnetic particles, and an insulation layer containing the certain additional element can be formed.

[Dust Core]

A dust core according to the present invention is a dust core obtained by compacting soft magnetic particles having an insulation coating. The dust core includes a machined surface on at least part of an outer peripheral surface of the core, the machined surface being formed by removing part of the core with a working tool. Soft magnetic particles that are adjacent to each other along the machined surface are isolated from each other through an insulation coating on the machined surface.

In this configuration, soft magnetic particles facing the machined surface are isolated from each other on the machined surface of the insulation coating without being connected to each other through a bridge portion. Therefore, when the dust core is used for various coil components, an increase in the eddy-current loss caused by electrical connection between the soft magnetic particles can be suppressed.

In one aspect of the dust core according to the present invention, the machined surface is a surface formed by a process that includes supplying an electric current using a workpiece as an anode.

As a result of this process, the shape of the heat-treated compact, which is a workpiece, can be easily changed into a desired shape. By using the workpiece as an anode, the constituent element of the soft magnetic particles constituting the heat-treated compact can be eluted through electrolysis or part of the soft magnetic particles can be removed through electrical discharge. In particular, a bridge portion that connects soft magnetic particles to each other, the soft magnetic particles being adjacent to each other, can be removed through the elution or electrical discharge.

In one aspect of the dust core according to the present invention, the machined surface includes an insulation layer containing at least one of an oxide and a hydroxide of a constituent element of the soft magnetic particles, and the insulation layer is formed through the supply of an electric current.

By forming a certain insulation layer on the machined surface, an insulation layer having a function equal to that of the insulation coating can be formed on the machined surface where an insulation coating has been removed by machining, and the exposure of the soft magnetic particles can be suppressed.

In one aspect of the dust core according to the present invention, an insulation layer containing at least one of an oxide and a hydroxide of a constituent element of the soft magnetic particles is formed in a portion where the insulation coating has come off, the portion being present on the outer peripheral surface of the dust core other than the machined surface, and the insulation layer is formed through the supply of an electric current.

In this configuration, when a portion where an insulation coating has come off by being damaged is present on a surface other than the machined surface, by forming an insulation layer in the portion, the portion can be recovered to a state that is equivalent to the state in which the insulation coating has been repaired.

In one aspect of the dust core according to the present invention, an electrical resistance value of a surface of the insulation layer is higher than or equal to ⅕ of an electrical resistance value of a surface of a heat-treated compact before machining. In particular, the electrical resistance value of the surface of the insulation layer is preferably higher than or equal to the electrical resistance value of the surface of the heat-treated compact before machining.

By setting the electrical resistance value of the insulation layer to be the above-described value, the insulation property of soft magnetic particles adjacent to each other can be sufficiently ensured. When the dust core is used for various coil components, an increase in the eddy-current loss caused by electrical connection between the soft magnetic particles can be suppressed. The ratio of the electrical resistance values is more preferably ⅓ or higher and further preferably ½ or higher. In particular, when the ratio is 1.0 or higher, the insulation between the soft magnetic particles can be further sufficiently ensured. The ratio of the electrical resistance values is particularly preferably 5.0 or higher and more preferably 7.0 or higher.

In one aspect of the dust core according to the present invention, the electrical resistance value of the surface of the insulation layer is 150 μΩm or higher.

By setting the electrical resistance value of the insulation layer to be the above-described value, the insulation property of soft magnetic particles adjacent to each other can be sufficiently ensured. When the dust core is used for various coil components, an increase in the eddy-current loss caused by electrical connection between the soft magnetic particles can be suppressed. The electrical resistance value is more preferably 300 μΩm or higher and particularly preferably 500 μΩm or higher. The electrical resistance value of the surface of a dust core that is not subjected to machining tends to increase as the average particle size of the soft magnetic particles decreases. For example, when the average particle size of soft magnetic particles constituting a dust core is 50 μm, the electrical resistance value is about $10^6$ to $10^8$ μΩm. Therefore, it is believed in the dust core of the present invention that the electrical resistance value of the surface of the insulation layer formed on the machined surface also increases as the average particle size of the soft magnetic particles decreases.

[Coil Component]

A coil component of the present invention that uses the dust core of the present invention includes the above-described dust core and a coil disposed on a periphery of the dust core.

In this configuration, by using the dust core of the present invention, the insulation between soft magnetic particles on the surface of the dust core is sufficiently ensured. Thus, a coil component having low eddy-current loss can be provided.

Advantageous Effects of Invention

In the dust core of the present invention, since an electrically connected portion between soft magnetic particles adjacent to each other is removed, the eddy-current loss can be reduced. In the method for producing a dust core of the present invention, since an electric current is supplied to the heat-treated compact, an electrically connected portion between soft magnetic particles adjacent to each other can be removed. Furthermore, in the coil component of the present invention, the eddy-current loss of a coil component used for electrical appliances equipped with solenoid valves, motors, or power supply circuits can be reduced.

DESCRIPTION OF EMBODIMENTS

Figure 1:
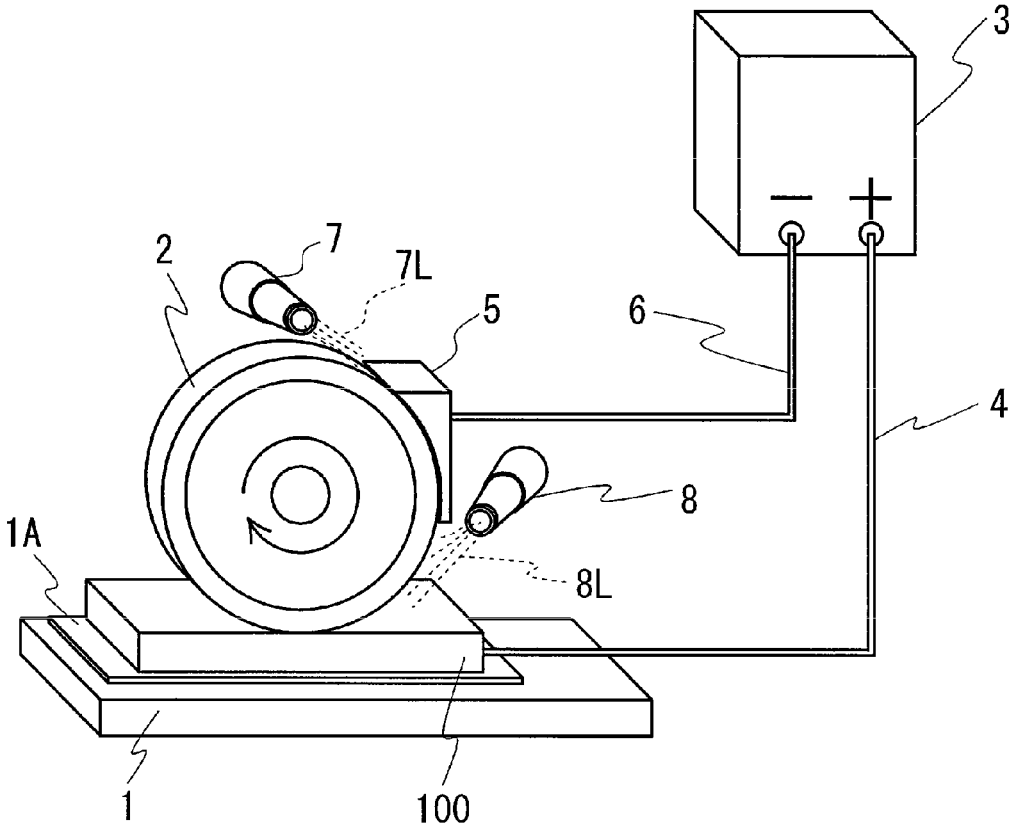
FIG. 1 is a schematic configuration diagram of an apparatus used to perform a method according to a first embodiment of the present invention.

Embodiments of the present invention will now be described with reference to the attached drawings. In each of the drawings, the same or corresponding components are denoted by the same reference numerals. In a first embodiment, a production apparatus used for producing a dust core will be described first, followed by a method for producing a dust core, a dust core obtained by the method, and a coil component that uses the dust core.

First Embodiment

Production Apparatus of Dust Core

As shown in FIG. 1, this apparatus includes a table 1 that supports a heat-treated compact 100 to be a dust core, a working tool 2 that machines the heat-treated compact 100, a power supply 3, an anode wire 4 that connects the power supply 3 to the heat-treated compact 100 serving as an anode, a cathode wire 6 that connects the power supply 3 to a first counter electrode 5 serving as a cathode, a conductive fluid nozzle 7 that supplies a conductive fluid 7L between the working tool and the cathode, and a grinding fluid nozzle 8 that supplies a grinding fluid 8L between the working tool and the heat-treated compact. As described in detail below, the heat-treated compact 100 is machined while an electric current is supplied between the anode and the cathode.

{Table and Working Tool}

The table 1 is a base that supports the heat-treated compact 100 to be machined with the working tool 2. At least one of the table 1 and the working tool 2 includes a moving mechanism (not shown) so that the positions of the table 1 and working tool 2 can be relatively changed. An insulation sheet 1A for electrically insulation the table 1 from the heat-treated compact 100 is disposed on the surface of the table 1. The insulation sheet 1A prevents an electric current, which is supplied to the heat-treated compact 100 from the power supply 3 through the anode wire 4, from leaking to the main body of a machining apparatus (not shown) through the table 1. The insulation sheet 1A may be disposed between the table 1 and the main body of the machining apparatus. The working tool 2 is a machining tool that removes part of the heat-treated compact 100 on the table 1 and changes the shape of the heat-treated compact 100. Examples of the working tool 2 include grinding wheels, cutting tools, chopping tools, and polishing tools.

In FIG. 1, a metal bonded grinding wheel is illustrated as the working tool 2. Examples of other grinding wheels include grinding wheels that use vitrified, resinoid, rubber, silicate, shellac, electrodeposit, or magnesia as a bond. Diamond, cBN, alumina, and silicon carbide can be suitably used for abrasive grains. Examples of a grinding method that uses such grinding wheels include various methods such as surface grinding, cylindrical grinding, and internal grinding. In the drawing, a surface grinder is illustrated as an example.

Examples of the cutting tool include a tool bit and an end mill. Examples of the chopping tool include a wire for wire electric discharge machining and a saw wire. Examples of the polishing tool include a polishing surface plate and a polishing buff.

The working tool 2 is preferably conductive. In general, most of cutting tools are made of a conductive material such as a high-speed steel or a cemented carbide. Chopping tools are also normally made of a metal and thus have conductivity. Among grinding wheels, a metal bonded grinding wheel and a resin/metal bonded grinding wheel have conductivity. Cast iron, cobalt, bronze, steel, tungsten, and nickel can be suitably used as a metal that is utilized for a bond of the grinding wheels. As described in the first embodiment and a third embodiment below, when the working tool 2 does not serve as a cathode, the working tool 2 does not necessarily have conductivity.

The constituent metal of the working tool 2, for example, the element added to cast iron is at least one element selected from Al, Si, Ti, Mg, Ca, Cr, Zr, P, and B. When the working tool 2 contains such an additional element, the additional element diffuses to soft magnetic particles constituting a heat-treated compact, and the additional element eluted from the soft magnetic particles forms an insulation layer on a machined surface of the heat-treated compact in the form of at least one of an oxide and a hydroxide. The insulation layer containing the additional element is expected to have improved insulation property and improved mechanical properties.

{Power Supply}

The power supply 3 supplies an electric current between the anode and the cathode through the anode wire 4 and the cathode wire 6. The power supply 3 is preferably a pulsed power supply that can supply a desired electric current between the electrodes at a desired voltage.

{Anode Wire and Anode}

The anode wire 4 supplies an electric current from the power supply 3 to the heat-treated compact 100 serving as an anode. As described in detail below, the heat-treated compact 100 is obtained as follows. Composite magnetic particles including soft magnetic particles and insulation coatings that cover the peripheries of the soft magnetic particles are compacted to form a compact, and then the compact is heat-treated to obtain the heat-treated compact 100. The heat-treated compact 100 serving as the anode is placed on the table 1 constituting the production apparatus.

{Cathode Wire and Cathode}

The cathode wire 6 connects the power supply 3 to the first counter electrode 5 serving as a cathode. The cathode wire 6 and the anode wire 4 form a current path of power supply-anode (heat-treated compact)-working tool-cathode (first counter electrode)-power supply. The first counter electrode 5 is a component disposed so as to face the working tool 2 with a certain distance therebetween. The first counter electrode 5 is composed of a material having conductivity and proper mechanical strength, such as copper, stainless steel, or graphite. The shape of the first counter electrode 5 is determined in accordance with the shape of the working tool 2, and is preferably a shape that achieves a uniform distance between the working tool and the first counter electrode. In this embodiment, the first counter electrode 5 is constituted by a block whose surface facing the working tool 2 is an arc-like curved shape that corresponds to the outer peripheral surface of the grinding wheel. The distance between the first counter electrode 5 and the working tool 2 is preferably about 0.05 to 0.3 mm. At least one of the first counter electrode 5 and the working tool 2 preferably includes a moving mechanism so that the distance can be kept constant by relatively moving the first counter electrode 5 and the working tool 2.

{Conductive Fluid Nozzle}

The conductive fluid nozzle 7 supplies a conductive fluid 7L sent from the supply source (not shown) of the conductive fluid 7L between the working tool and the cathode. The conductive fluid 7L needs to have electrical conductivity so that the electrical connection between the working tool and the cathode can be achieved by supplying the conductive fluid 7L between the working tool and the cathode. Specifically, a conductive fluid having an electrical conductivity of 2 mS/cm or more is suitably used. When the conductive fluid 7L is a weakly alkaline (about pH 11) water-soluble fluid, which is not an electrolytic solution having high corrosiveness, excessive corrosion is not caused on the working tool 2 and the heat-treated compact 100. The conductive fluid 7L may be a commercially available grinding fluid as long as it has desired conductivity and alkalinity.

{Grinding Fluid Nozzle}

The grinding fluid nozzle 8 supplies a grinding fluid 8L sent from the supply source (not shown) of the grinding fluid between the working tool and the heat-treated compact. The grinding fluid 8L may be basically any grinding fluid as long as it can reduce the friction between the working tool 2 and the heat-treated compact 100. The grinding fluid 8L preferably has conductivity.

The grinding fluid 8L may be a fluid that is the same as or different from the conductive fluid 7L. In the case where the grinding fluid 8L is the same fluid as the conductive fluid 7L, a conductive fluid/grinding fluid may be supplied from a single fluid supply source and, if necessary, the conductive fluid/grinding fluid may be supplied between the heat-treated compact and the first counter electrode and between the working tool and the heat-treated compact from a plurality of nozzles. In this embodiment, the grinding fluid 8L is the same fluid as the conductive fluid 7L.

[Method for Producing Dust Core]

A method for producing a dust core with the above-described apparatus includes a preparation step of a heat-treated compact and a machining step of the heat-treated compact. In the preparation step, soft magnetic particles having an insulation coating are compacted to obtain a compact, and then the compact is heat-treated to prepare a heat-treated compact. In the machining step, part of the heat-treated compact is removed using a working tool while an electric current is supplied with a conductive fluid between the heat-treated compact serving as an anode and a first counter electrode serving as a cathode.

{Preparation Step}

<<Soft Magnetic Particles>>

Soft magnetic particles are preferably made of a metal containing 50% or more by mass of iron, which is, for example, pure iron (Fe). In addition, an iron alloy such as at least one alloy selected from an Fe—Si alloy, an Fe—Al alloy, an Fe—N alloy, an Fe—Ni alloy, an Fe—C alloy, an Fe—B alloy, an Fe—Si—B alloy, an Fe—Co alloy, an Fe—P alloy, an Fe—Ni—Co alloy, and an Fe—Al—Si alloy can be used. In particular, pure iron containing 99% or more by mass of Fe is preferably used in terms of magnetic permeability and magnetic flux density.

The average particle size of the soft magnetic particles is preferably 30 μm or more and 500 μm or less. When the average particle size of the soft magnetic particles is 30 μm or more, an increase in the coercive force and hysteresis loss of a dust core produced using a soft magnetic material can be suppressed without reducing the fluidity of the soft magnetic material. When the average particle size of the soft magnetic particles is 500 μm or less, the eddy-current loss generated in a high frequency range of 1 kHz or more can be effectively reduced. The average particle size of the soft magnetic particles is more preferably 40 μm or more and 300 μm or less. When the lower limit of the average particle size is 40 μm or more, the eddy-current loss is reduced and the soft magnetic material is easily handled, resulting in a compact having higher density. The average particle size mentioned herein means a particle size of a particle at which the cumulative sum of the masses of particles from the smallest particle reaches 50% of the total mass in a particle size histogram, i.e., a 50% particle size.

<<Insulation Coating>>

The insulation coating that coats the surface of the soft magnetic particles can suppress the contact between the soft magnetic particles and can reduce the relative permeability of the compact. Furthermore, the presence of the insulation coating can suppress the flow of an eddy current between the soft magnetic particles and thus can reduce the eddy-current loss of a dust core.

The insulation coating is not particularly limited as long as it has good insulation property. For example, a phosphate, a titanate, a silicate, and a magnesia can be suitably used. In particular, an insulation coating composed of a phosphate has good deformability. Therefore, even if the soft magnetic particles are deformed when a dust core is produced by compacting the soft magnetic particles, the insulation coating can follow the deformation. Furthermore, a phosphate film has high adhesion to iron-based soft magnetic particles and thus does not easily come off from the surfaces of the soft magnetic particles. Examples of the phosphate include metal phosphate compounds such as iron phosphate, manganese phosphate, zinc phosphate, and calcium phosphate.

An example of other insulation coatings is a silicone film. A silicone film may be directly formed on the periphery of the soft magnetic particles or may be formed, as an outer insulation coating, on an inner insulation coating composed of a phosphate or the like. In particular, the silicone film is suitably composed of a silicone that cures through a hydrolysis/polycondensation reaction. Typically, a compound represented by $Si_m(OR)_n$ (m and n are each a natural number) can be used. OR represents a hydrolytic group. Examples of the hydrolytic group include an alkoxy group, an acetoxy group, a halogen group, an isocyanate group, and a hydroxyl group. Examples of the alkoxy group include methoxy, ethoxy, propoxy, isopropoxy, butoxy, sec-butoxy, and tert-butoxy.

Since a silicone film formed through the hydrolysis/polycondensation of a resin material has high deformability, fractures and cracks are not easily caused when a soft magnetic material is pressurized and the silicone film is hardly detached from the surface of the insulation coating. In addition, since the silicone film has high heat resistance, good insulation property can be maintained even if the temperature of a heat treatment performed after the compaction of the soft magnetic material is high. Moreover, when an inner insulation coating composed of a phosphate or the like is formed on the surface of the soft magnetic particles, the silicone film also protects the inner insulation coating from heat or the like.

Such a silicone film can be formed by mixing soft magnetic particles or soft magnetic particles having a phosphate film with a resin material in a heating atmosphere of 80 to 160° C. This mixing provides a state in which the resin material coats the surface of each of the soft magnetic particles. Water molecules contained in the mixing atmosphere or water of hydration (if the phosphate film contains water of hydration) causes the hydrolysis/polycondensation of the resin material and thus the silicone film is formed.

The thickness of the insulation coating is preferably 10 nm or more and 1 μm or less. When the thickness of the insulation coating is 10 nm or more, the contact between the soft magnetic particles can be suppressed and the energy loss due to an eddy current can be effectively suppressed. When the thickness of the insulation coating is 1 μm or less, the ratio of the insulation coating in the composite magnetic particles is prevented from excessively increasing. Thus, the magnetic flux density of the composite magnetic particles can be prevented from significantly decreasing.

<<Compaction>>

The above-described soft magnetic particles having an insulation coating are typically formed into a compact by being inserted into a mold having a desired shape and then by being compacted under pressure. The pressure can be suitably selected. For example, if a dust core used for electrical appliances equipped with solenoid valves, motors, or power supply circuits is produced, the pressure is preferably about 600 to 1400 MPa (and more preferably 800 to 1000 MPa).

<<Heat Treatment>>

The compact undergoes a heat treatment step. In the heat treatment step, the distortion and dislocation introduced into the soft magnetic particles in the compaction process are removed, and the adhesion between the soft magnetic particles through the insulation coating is increased. As the heat treatment temperature is increased, the removal of distortion and dislocation becomes more sufficient. Therefore, the heat treatment temperature is preferably 300° C. or higher, more preferably 400° C. or higher, and particularly preferably 450° C. or higher. In consideration of the heat resistance of the insulation coating, the upper limit of the heat treatment temperature is about 900° C. At such a heat treatment temperature, distortion can be removed and also lattice defects such as dislocation introduced into the soft magnetic particles under pressure can be removed. This eases the movement of domain walls of a dust core obtained and decreases the coercive force Hc, which contributes to a reduction in hysteresis loss.

{Machining Step}

Figure 2:
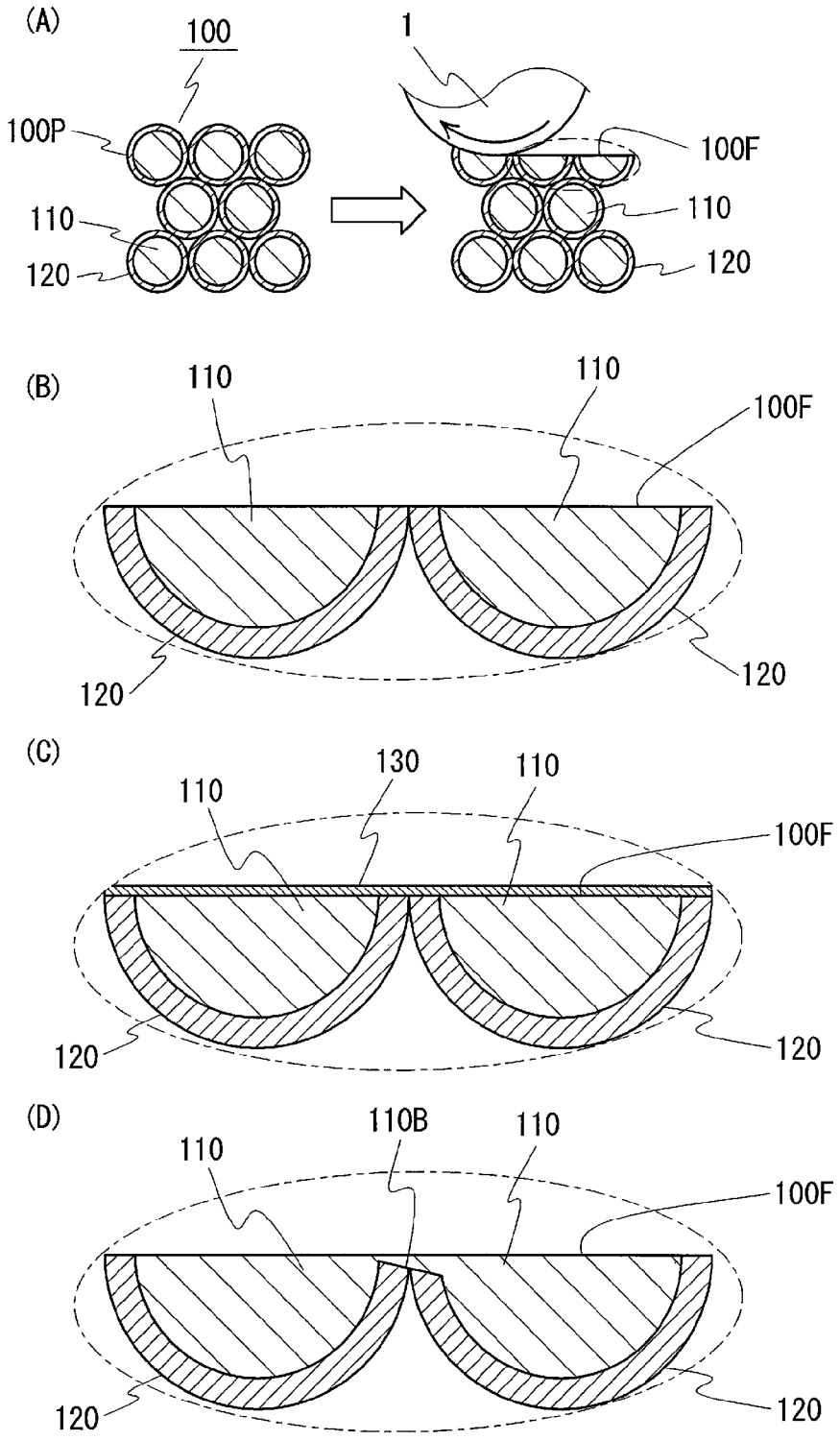
FIG. 2(A) is a schematic explanatory diagram showing the state in which a heat-treated compact is being ground.
FIG. 2(B) is a schematic enlarged view showing the state in which a bridge portion of the heat-treated compact has been removed by the method according to the first embodiment.
FIG. 2(C) is a schematic enlarged view showing the state in which an insulation layer is formed on a ground surface where a bridge portion has been removed by the method according to the first embodiment.
FIG. 2(D) is a schematic enlarged view showing a heat-treated compact having a bridge portion formed by a conventional method.

In the machining step, as shown in FIG. 2(A), machining for removing part of the heat-treated compact 100 with the working tool 2 such as a grinding wheel is performed so that the heat-treated compact 100 has a desired shape. In this machining, part of an insulation coating 120 formed on soft magnetic particles 110 in composite magnetic particles 100P that constitute the heat-treated compact 100 is removed with a grinding wheel and thus a machined surface 100F is formed. The soft magnetic particles 110 not covered with the insulation coating 120 are exposed at the machined surface 100F. FIGS. 2(B) to 2(D) are enlarged views of a region enclosed with a broken line in FIG. 2(A). If the heat-treated compact is simply ground with a grinding wheel, as shown in FIG. 2(D), the soft magnetic particles 110 that are adjacent to each other facing the machined surface 100F may be connected to each other through a bridge portion 110B due to the plastic deformation during the grinding. Therefore, in the machining, the bridge portion 110B is removed by supplying an electric current while providing a conductive fluid between the heat-treated compact serving as an anode and the first counter electrode serving as a cathode.

<<Removal Step>>

The reason why the bridge portion 110B can be removed in the machining step is assumed to be as follows. The working tool 2 is in contact with the heat-treated compact 100 to be machined. However, from the microscopic viewpoint of the contact interface, some abrasive grains are in contact with the heat-treated compact 100 while tiny spaces are formed between the heat-treated compact 100 and other abrasive grains or a bond. A grinding fluid 8L also serving as a conductive fluid 7L is present in the spaces (FIG. 1). Therefore, when a pulsed current is supplied to the heat-treated compact 100 from the power supply 3, a constituent element (e.g., Fe) of the soft magnetic particles is eluted at the machined surface through electrolysis. An electrical discharge is also generated between the working tool 2 and the heat-treated compact 100. Since the bridge portion 110B is extremely thin, the bridge portion 110B is selectively removed due to at least one of the electrolysis and the heat generation caused by electrical discharge. This removal step realizes the machined surface of the heat-treated compact on which the soft magnetic particles 110 adjacent to each other are isolated from each other through the insulation coating 120 as shown in FIG. 2(B). The pulsed current is preferably supplied at a pulsed voltage of about 40 to 200 V and an average current of about 0.5 to 20 A.

{Coating Step}

After the removal step, a coating step of forming an insulation layer that contains at least one of an oxide and a hydroxide of the element eluted through electrolysis is preferably performed. This coating step can be performed successively after the machining step by only changing the relative positions of the working tool 2 and the heat-treated compact 100 to provide a certain distance therebetween while supplying an electric current. In this coating step, the heat-treated compact 100 is not ground, and soft magnetic particles at the machined surface are eluted through electrolysis. An element eluted from the soft magnetic particles is oxidized or hydroxylated and thus an oxide film or a hydroxide film is formed on the machined surface. As shown in FIG. 2(C), the oxide film or the hydroxide film becomes an insulation layer 130 that covers the machined surface 100F of the soft magnetic particles from which the insulation coating 120 has been removed. Therefore, on the surface of the heat-treated compact, the soft magnetic particles 110 can be prevented from being exposed. As described above, since the insulation layer 130 is formed while containing at least one of an oxide or a hydroxide of the element eluted from the soft magnetic particles, the insulation layer 130 is normally composed of a material different from that of the insulation coating 120 that covers the soft magnetic particles 110.

It is believed that the insulation layer 130 is also formed during the removal step. However, in the removal step, the formed insulation layer 130 is often removed with the working tool. Thus, the coating step is preferably performed while a certain distance is provided between the working tool 2 and the heat-treated compact 100 after the removal step. In the grinding or cutting process, zero-cut (spark-out) in which the depth of cut becomes zero is normally performed just before the completion of the process. At this moment, the working tool 2 is in substantially noncontact with the heat-treated compact 100 and the machining of the heat-treated compact substantially does not proceed. Thus, the insulation layer 130 is easily formed and the machined surface can be covered with the insulation layer 130 with certainty. In particular, the distance between the working tool 2 and the heat-treated compact 100 that are in noncontact with each other is preferably about 0.000 to 0.3 mm. By keeping the distance, the constituent element of the soft magnetic particles 110 can be eluted and the insulation layer can be properly formed. Normally, the lower limit of the distance is often about 0.005 mm. This restriction of the distance is common in other embodiments described below. Also in this coating step, an electrical discharge is generated between the working tool 2 and the heat-treated compact 100. Therefore, even if the bridge portion 110B remains left after the removal step, the bridge portion 110B can be removed with certainty by the electrical discharge or electrolysis in the coating step.

[Dust Core]

A dust core of the present invention is produced through the steps above. The dust core is a dust core obtained by compacting soft magnetic particles having an insulation coating. The dust core includes a machined surface on at least part of an outer peripheral surface of the core, the machined surface being formed by removing part of the core with a working tool. The soft magnetic particles adjacent to each other along the machined surface are isolated from each other through the insulation coating on the machined surface. As described above, since the bridge portion can be removed in the removal step, the soft magnetic particles 110 that are adjacent to each other facing the machined surface 100F are electrically insulated from each other in an independent manner as shown in FIG. 2(B) or FIG. 2(C). As a result, when various coil components are produced using the dust core, the eddy-current loss can be reduced.

[Coil Component]

Figure 3:
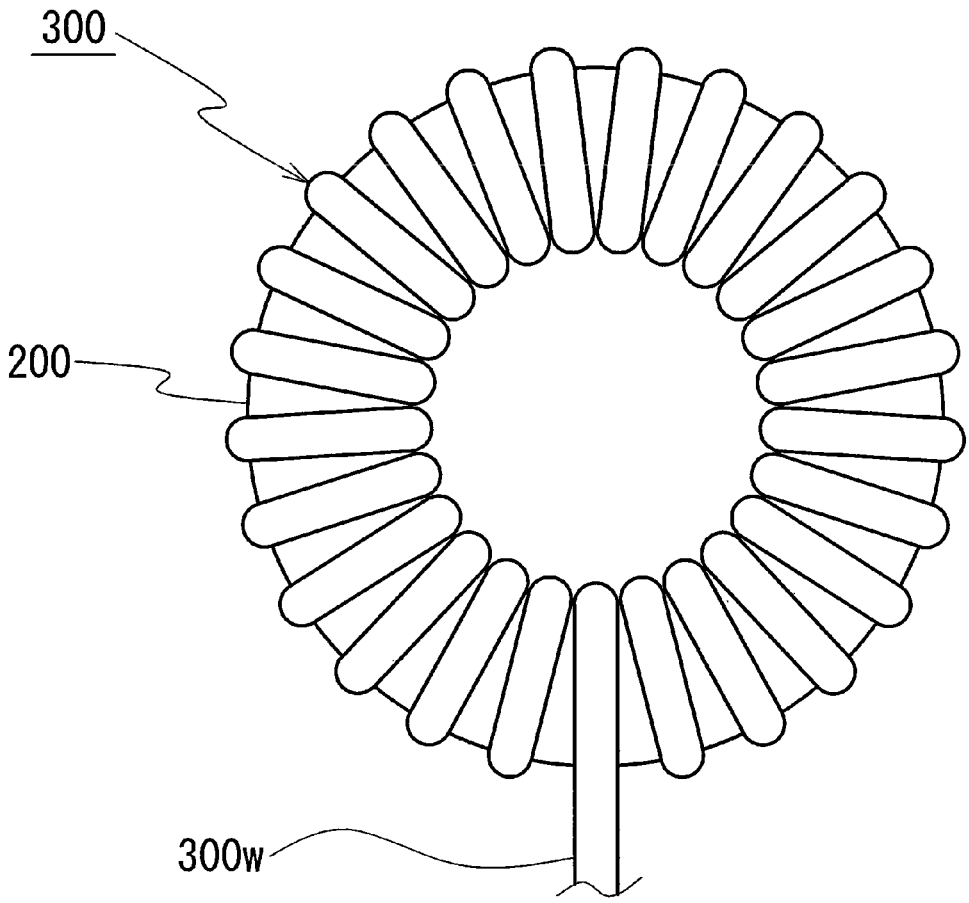
FIG. 3 is a plan view of a choke coil constituted by a dust core according to the first embodiment.

The above-described dust core can be used for a coil component of electrical appliances equipped with solenoid valves or power supply circuits. As shown in FIG. 3, an example of the coil component is a choke coil including a toroidal core 200 and a coil 300 formed by winding a winding 300*w* on the periphery of the toroidal core 200. The toroidal core 200 is constituted by the above-described dust core. Therefore, soft magnetic particles constituting the toroidal core 200 are sufficiently insulated from each other, and the eddy-current loss generated when the coil 300 is exited can be reduced.

Second Embodiment

In the first embodiment, the case where the first counter electrode facing the working tool is used as a cathode has been described. Herein, a production apparatus of a dust core in which the first counter electrode is removed and the working tool is directly used as a cathode and a method for producing a dust core will be described with reference to FIG. 4. In this embodiment, the main difference from the first embodiment is that the working tool is used as a cathode. Thus, the description below will be made focusing on the difference. Other apparatus configuration is the same as that of the first embodiment unless otherwise specified.

Figure 4:
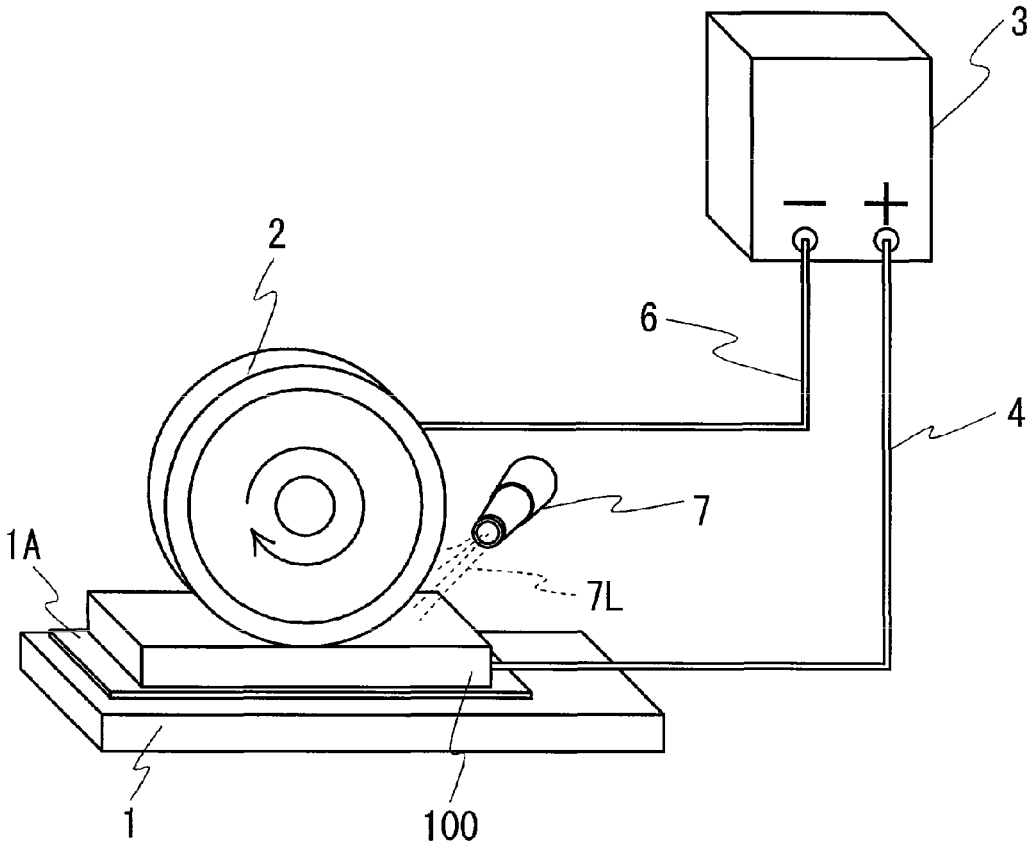
FIG. 4 is a schematic configuration diagram of an apparatus used to perform a method according to a second embodiment of the present invention.

As shown in FIG. 4, a cathode wire 6 of this embodiment is connected to a working tool 2. In the drawing, the cathode wire 6 seems to be connected to the periphery of a disc-shaped grinding wheel, but is, in reality, electrically connected to the grinding wheel through a rotating shaft of the grinding wheel using a brush electrode or the like. The working tool 2 of this embodiment has conductivity because it is used as a cathode.

In this embodiment, a conductive fluid nozzle 7 is disposed so as to supply a conductive fluid 7L between the working tool 2 and a heat-treated compact 100. The conductive fluid 7L reduces the friction between the working tool 2 and the heat-treated compact 100 and also functions as a grinding fluid that cools the heat-treated compact 100.

In this apparatus, machining is performed while an electric current is supplied between the anode and the cathode, that is, between the heat-treated compact and the working tool. During grinding, the working tool 2 and the heat-treated compact 100 are in contact with each other, and electrolysis and electrical discharge are generated at the contact interface as in the first embodiment. Therefore, it is believed that the bridge portion 110B shown in FIG. 2(D) is removed due to the electrolysis and the heat generation caused by the electrical discharge. As a result, the soft magnetic particles that are adjacent to each other along the machined surface 100F can be isolated from each other through an insulation coating 120 (FIG. 2(B)).

After the grinding, a space is created between the working tool 2 and the heat-treated compact 100 so that they are in noncontact with each other. The conductive fluid 7L is supplied to the space while an electric current is supplied. Through the supply of an electric current, the soft magnetic particles on the machined surface of the heat-treated compact 100 are electrolyzed, and an insulation layer containing an element of the eluted soft magnetic particles is formed on the machined surface. As a result, an insulation layer 130 is formed on the machined surface and thus a state in which the soft magnetic particles on the machined surface are covered with the insulation layer can be achieved (FIG. 2(C)).

Furthermore, in this embodiment, the first counter electrode 5 used in the first embodiment is not required. The conductive fluid 7L (grinding fluid) may be supplied between the working tool 2 and the heat-treated compact 100.

Third Embodiment

In the first embodiment, the case where the first counter electrode facing the working tool is used as a cathode has been described. In the second embodiment, the case where the working tool is used as a cathode has been described. A production apparatus of a dust core in which a second counter electrode facing the heat-treated compact is used as a cathode and a method for producing a dust core will be described with reference to FIG. 5. In this embodiment, the main difference from the first embodiment is that a second counter electrode 9 is used as a cathode. Thus, the description below will be made focusing on the difference. Other apparatus configuration is the same as that of the first embodiment unless otherwise specified.

In this embodiment, a second counter electrode 9 is disposed independently from a working tool 2 and the counter electrode 9 is held so that a certain distance is provided between the counter electrode 9 and the heat-treated compact 100. The heat-treated compact 100 is machined with the working tool 2 while supplying an electric current and providing a conductive fluid 7L between the heat-treated compact 100 serving as an anode and the counter electrode 9 serving as a cathode.

The second counter electrode 9 is composed of the same material as that of the first counter electrode of the first embodiment. The shape of the counter electrode 9 is determined in accordance with the shape of the heat-treated compact 100 serving as an anode, and is preferably a shape that achieves a uniform distance between the anode and the counter electrode. In this embodiment, the counter electrode 9 is constituted by a block. The distance between the counter electrode 9 and the anode (heat-treated compact 100) is preferably about 0.000 to 0.3 mm. Normally, the lower limit of the distance is often about 0.005 mm. This restriction of the distance is common in other embodiments described below. The distance is preferably kept constant during the removal step and coating step by disposing a moving mechanism (not shown) that changes the relative positions of the counter electrode 9 and heat-treated compact 100.

In the apparatus used in this embodiment, a facing portion of the working tool and the heat-treated compact is different from a facing portion of the second counter electrode and the heat-treated compact. Therefore, an electric current is not necessarily supplied to the working tool 2 or may be supplied as in the first and second embodiments. In this embodiment, an electric current is not supplied to the working tool 2. However, in the case of this embodiment, to form an insulation layer on the machined surface, the machined surface and the second counter electrode 9 need to be caused to face each other with a certain distance therebetween after grinding and an electric current needs to be supplied therebetween.

In the case of this embodiment, since an electric current is not supplied to the working tool 2, a bridge portion that connects adjacent soft magnetic particles to each other is formed on the machined surface of the heat-treated compact 100. However, the bridge portion can be removed through at least one of electrical discharge and electrolysis by relatively moving the second counter electrode 9 and the heat-treated compact 100 after grinding, causing the machined surface to face the second counter electrode 9 with a certain distance therebetween, and supplying an electric current therebetween. Furthermore, an insulation layer containing at least one of an oxide and a hydroxide of an element eluted from soft magnetic particles can be formed on the machined surface of the heat-treated compact 100 that faces the counter electrode 9. Consequently, the soft magnetic particles facing the machined surface can be insulated from each other and can be prevented from being exposed.

In the case of this embodiment, when a damaged portion of the insulation coating is present on a surface of the heat-treated compact 100 other than the machined surface, an insulation layer can be formed on the damaged portion to repair the insulation coating. In the heat-treated compact 100, the insulation coating may be damaged when soft magnetic particles are compacted or the resultant compact is drawn out of a mold. The soft magnetic particles are exposed from the damaged portion. Therefore, an insulation layer can be formed on the damaged portion by causing the counter electrode 9 to face the damaged portion and supplying a pulsed current between the heat-treated compact and the second counter electrode. In particular, when an electric current is supplied while keeping the distance between the counter electrode 9 and the heat-treated compact 100 and changing the relative positions thereof, the insulation coating can be easily repaired in a wide area of the surface of the heat-treated compact 100.

In the above-described method for producing a dust core, the electrical connection between soft magnetic particles adjacent to each other can be suppressed. In addition, the area of an exposed portion of the soft magnetic particles can be reduced on the machined surface and even on a surface other than the machined surface, which provides a coil component having lower eddy-current loss.

Fourth Embodiment

A method for producing a dust core of the present invention in which the second counter electrode in the third embodiment also functions as a conductive fluid nozzle will now be described with reference to FIG. 6. The difference between this embodiment and the third embodiment is that a conductive fluid nozzle 7 also functions as a second counter electrode 9. Other points are basically the same as those of the third embodiment.

In this embodiment, a pulsed current is supplied between the heat-treated compact 100 serving as an anode and the conductive fluid nozzle 7 also serving as the second counter electrode 9 (cathode). Herein, the conductive fluid nozzle 7 needs to be composed of a conductive material. The conductive fluid nozzle 7 preferably has a flat shape in which the outer peripheral surface of the nozzle is a plane surface, so that the conductive fluid nozzle 7 and the heat-treated compact 100 face each other in a larger area. In FIG. 6, the nozzle 7 is illustrated in a simplified manner. Nozzle outlets of the conductive fluid 7L are arranged on the left end of the conductive fluid nozzle 7 and furthermore nozzle outlets of the conductive fluid 7L are arranged on the surface facing the heat-treated compact 100.

As in the third embodiment, the bridge portion can also be removed and an insulation layer can also be formed in this embodiment. In addition, by using the conductive fluid nozzle 7 as the counter electrode 9, the second counter electrode is not required, which can simplify the apparatus configuration.

Fifth Embodiment

An embodiment that performs a method of the present invention using a cylindrical grinder will now be described with reference to FIG. 7. The difference is that a surface grinder is used in the first embodiment whereas a cylindrical grinder is used in this embodiment. The description below will be made focusing on the difference.

In this embodiment, a first counter electrode 5 serves as a cathode and a rod-shaped heat-treated compact 100B serves as an anode. The first counter electrode 5 and the heat-treated compact 100B are each arranged so as to face a disc-shaped grinding wheel, which is a working tool 2, with a certain distance therebetween. As in the first counter electrode 5 of the first embodiment, the first counter electrode 5 has an arc-like curved concave surface that corresponds to the outer peripheral surface of the cylindrical working tool, and is connected to a negative pole of a power supply 3 through a cathode wire 6. The heat-treated compact 100B has one end that is coaxially supported by an insulation jig 11 so as to be rotatable using the axis of the jig 11 as a rotation axis. The rotation axis of the grinding wheel and the rotation axis of the heat-treated compact 100B are arranged in parallel. In the drawing, the rotational directions of the grinding wheel and the heat-treated compact 100B are the same, but the rotational directions may be opposite. By rotating the grinding wheel and the heat-treated compact 100B in a contact manner, the periphery of the heat-treated compact 100B in the central portion of the heat-treated compact 100B is ground. The heat-treated compact 100B has another end that is supported by a support (not shown), and the support is connected to a positive pole of the power supply 3 through an anode wire 4. The electrical connection between the support and the heat-treated compact 100B can be made using a sliding contact such as a brush. A conductive fluid 7L is supplied between the working tool 2 and the first counter electrode 5 from a conductive fluid nozzle 7. A grinding fluid 8L is supplied between the working tool 2 and the heat-treated compact 100B from a grinding fluid nozzle 8.

In the apparatus having such a configuration, when an electric current is supplied between the first counter electrode 5 and the heat-treated compact 100B, a constituent element of soft magnetic particles constituting the heat-treated compact 100B can be eluted through electrolysis or part of the soft magnetic particles can be removed through electrical discharge. By keeping supplying an electric current between the electrodes while properly holding the distance between the working tool 2 and the heat-treated compact 100B just before the completion of grinding or after the completion of grinding, the constituent element of the soft magnetic particles eluted through electrolysis is oxidized or hydroxylated to form an insulation layer on the ground surface. This can provide the insulation between the soft magnetic particles. When an insulation layer is formed on a surface other than the ground surface of the heat-treated compact 100B, the insulation layer can be easily formed by relatively moving the working tool 2 and the heat-treated compact 100B in an axial direction while holding a certain distance between the working tool 2 and the heat-treated compact 100B.

Sixth Embodiment

An embodiment that performs a method of the present invention using an internal grinder will now be described with reference to FIG. 8. The difference is that a surface grinder is used in the first embodiment whereas an internal grinder is used in this embodiment. The description below will be made focusing on the difference.

In this embodiment, a round-bar grinding wheel with a shaft is used as a working tool 2, and a hollow cylindrical heat-treated compact 100C is to be machined. The working tool 2 and the heat-treated compact 100C are arranged in a vertical direction. They are each independently supported by a rotatable supporting mechanism (not shown). The outer diameter of the working tool 2 is smaller than the inner diameter of the heat-treated compact 100C. The heat-treated compact 100C is ground by inserting the working tool 2 inside the heat-treated compact 100C and then pressing the outer peripheral surface of the tool 2 against the inner peripheral surface of the heat-treated compact 100C. During the grinding, a conductive fluid 7L is supplied from a conductive fluid nozzle 7 to a contact surface between the working tool 2 and the heat-treated compact 100C. In this embodiment, the conductive fluid 7L is a grinding fluid.

In such an apparatus, the working tool 2 is connected to a negative pole of a power supply 3 through a cathode wire 6. The heat-treated compact 100C is connected to a positive pole of the power supply 3 through an anode wire 4. That is, in this embodiment, the working tool 2 itself functions as a cathode as in the second embodiment.

Also in this embodiment, when grinding is performed while an electric current is supplied between the working tool 2 and the heat-treated compact 100C, a constituent element of soft magnetic particles constituting the heat-treated compact 100C can be eluted through electrolysis or part of the soft magnetic particles can be removed through electrical discharge. By keeping supplying an electric current between the electrodes while properly holding the distance between the working tool 2 and the heat-treated compact 100C just before the completion of grinding or after the completion of grinding, the constituent element of the soft magnetic particles eluted through electrolysis is oxidized or hydroxylated to form an insulation layer on the ground surface.

Seventh Embodiment

Figure 9:
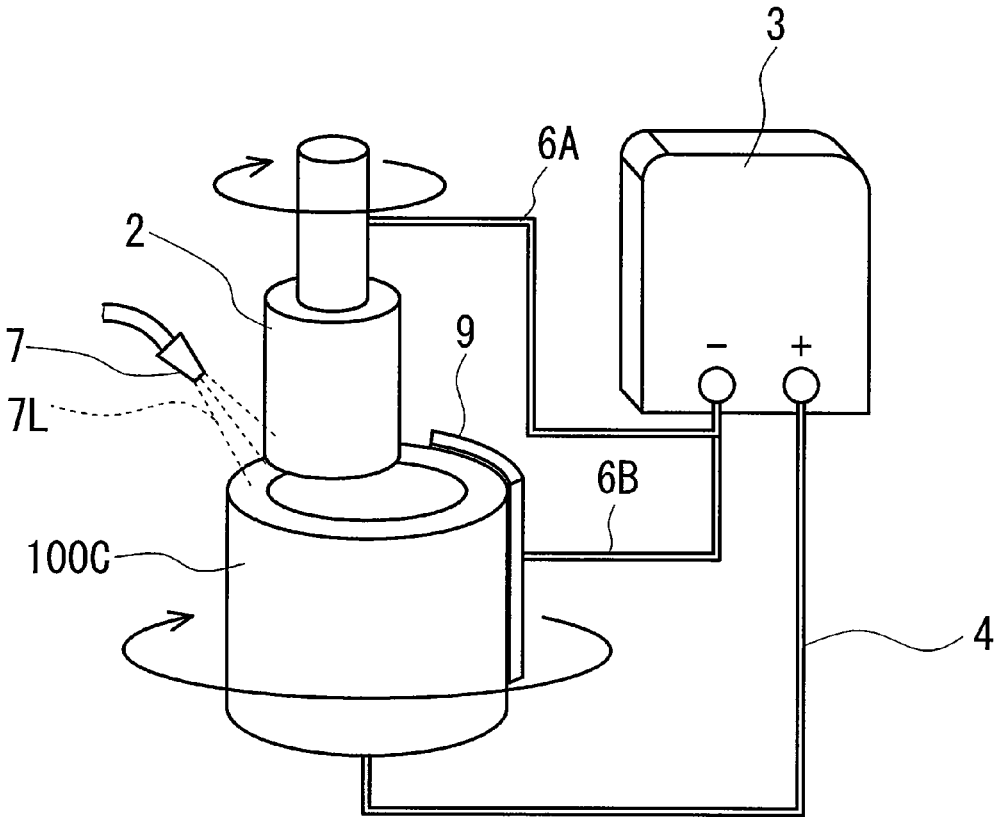
FIG. 9 is a schematic configuration diagram of an apparatus used to perform a method according to a seventh embodiment of the present invention.

An embodiment that performs a method of the present invention using an internal grinder will now be described with reference to FIG. 9. This embodiment is a modification of the sixth embodiment and differs from the sixth embodiment in that a second counter electrode 9 is disposed on the periphery of the heat-treated compact 100C to perform a re-insulation coating step. The description below will be made focusing on the difference.

In this embodiment, the cathode wire 6 is branched at the midway. A branched wire 6A is connected to the working tool 2 as in the sixth embodiment whereas a branched wire 6B is connected to a second counter electrode 9 arranged on the periphery of the heat-treated compact 100C with a certain distance therebetween. In this embodiment, the heat-treated compact 100C serves as an anode and the working tool 2 and second counter electrode 9 serve as cathodes. The second counter electrode 9 is constituted by an arc-like piece having a curved concave surface that corresponds to the outer peripheral surface of the heat-treated compact 100C.

The outer peripheral surface of the heat-treated compact 100C is not a surface to be ground. However, when a compact before heat treatment is drawn out of a mold, the insulation coating of soft magnetic particles is often damaged due to the sliding contact with the mold or the like. Therefore, even if a damaged portion of an insulation coating is present on the outer peripheral surface of the heat-treated compact 100C, by supplying an electric current in the apparatus of this embodiment, a layer containing at least one of an oxide and a hydroxide of a constituent element of soft magnetic particles can be formed on the damaged portion. As a result, the insulation coating can be repaired. This can provide sufficient insulation between the soft magnetic particles. In particular, if a second counter electrode 9 having a size that corresponds to the full length of the heat-treated compact 100C in the height direction (axial direction) is used, the insulation coating can be repaired across the entire outer peripheral surface of the compact 100C by rotating the heat-treated compact 100C. Obviously, as in the sixth embodiment, the bridge portion on the inner peripheral surface of the heat-treated compact 100C is removed during grinding. Furthermore, by keeping supplying an electric current while holding a certain distance between the working tool 2 and the inner peripheral surface of the heat-treated compact 100C just before the completion of grinding or after the completion of grinding, a layer containing at least one of an oxide and a hydroxide of a constituent element of the soft magnetic particles can be formed on the ground surface.

Example 1

As an example, surface grinding was performed on a heat-treated compact using the surface grinder of the first embodiment. As a comparative example, surface grinding was performed on a heat-treated compact without supplying a pulsed current. The machined surface after grinding was analyzed by thin film XRD, and the surface resistance of the machined surface was measured. The surface resistance (electrical resistance) was also measured on a heat-treated compact that was not subjected to grinding. The grinding conditions were as follows. Just before the completion of grinding, an electric current was supplied for 120 seconds while holding a distance of 0.01 mm between a grinding wheel and the heat-treated compact.

Surface Grinding Conditions

Depth of cut: 5 μm, Total machined amount: 0.5 mm

Grinding Wheel

Abrasive grain: Material: diamond, Grain size: #325

Bond: cast iron

Additional element: Si 0.1% by mass, P 0.1% by mass

Heat-Treated Compact

Soft magnetic particles: pure iron (average particle size: 200 μm)

Insulation coating: phosphate film

Supply Conditions of Electric Current

Pulsed voltage: 100 V

Average current: 5 A (XRD Analysis)

Figure 10:
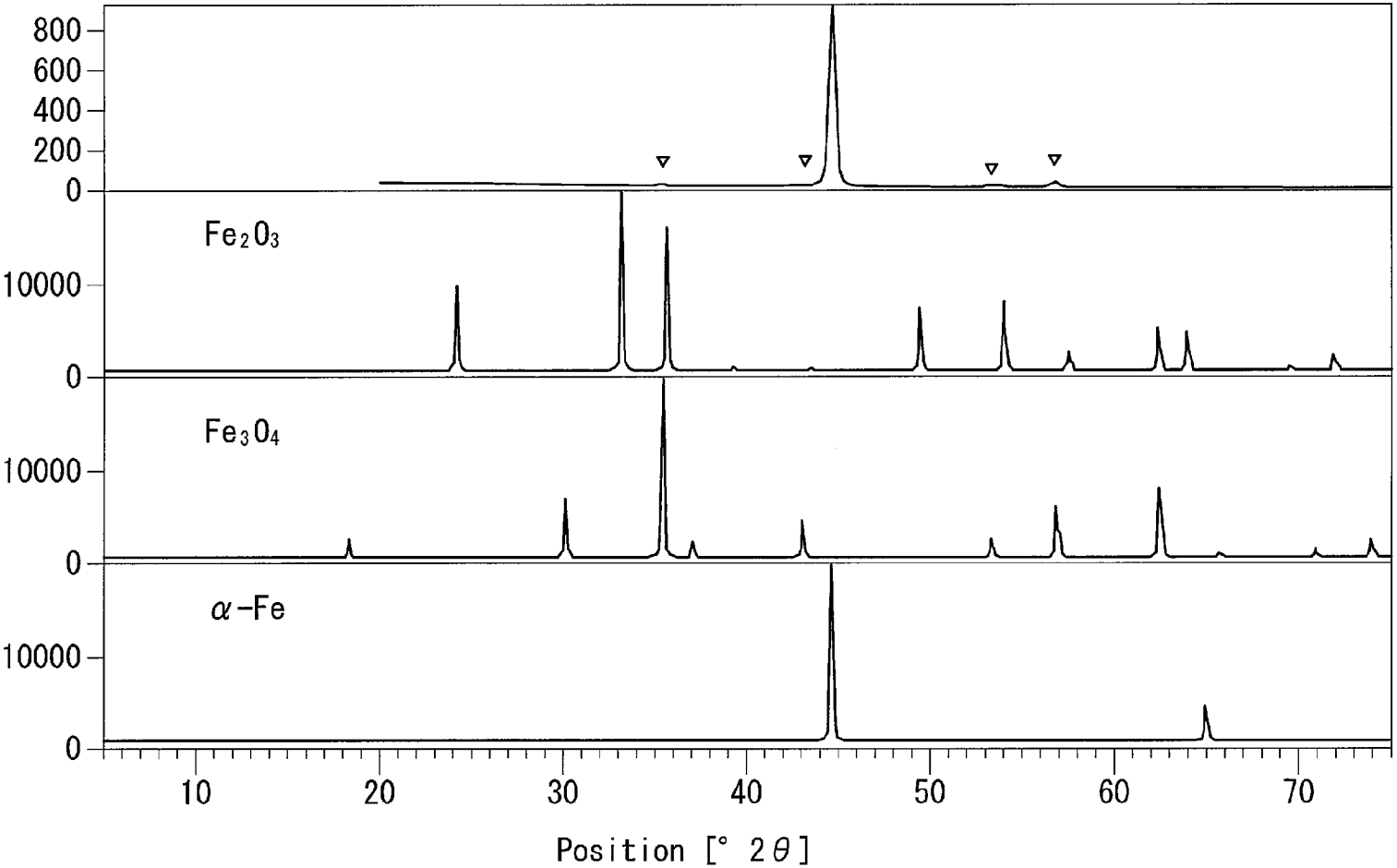
FIG. 10 is a pattern showing the thin film XRD analysis results of a machined surface of a heat-treated compact formed by the method according to the first embodiment.
Figure 11:
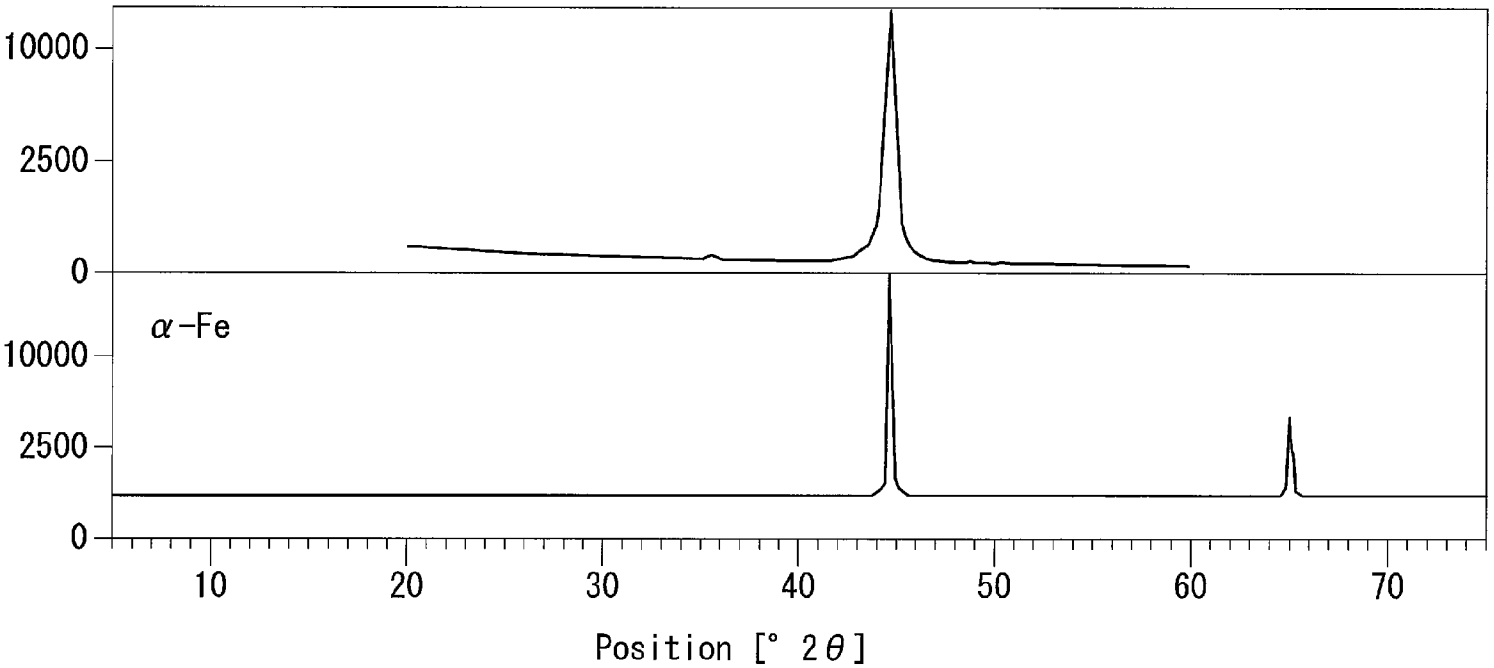
FIG. 11 is a pattern showing the thin film XRD analysis results of a machined surface of a heat-treated compact formed by a conventional method.

In a thin film XRD analysis, X' pert (Cu—Kα, mirror/parallel beam method, thin film method/θ fixed-2θ scanning) was used as an apparatus. FIG. 10 shows the analysis results of the example, and FIG. 11 shows the analysis results of the comparative example.

Comparing peaks of a measured pattern illustrated in the upper row of each of the drawings with peaks of standard patterns illustrated in other rows, α-Fe (material of soft magnetic particles), a trace amount of $Fe_3O_4$-like phase, and a $Fe_2O_3$-like phase were recognized in the example whereas only α-Fe (material of soft magnetic particles) was recognized in the comparative example. That is, it is assumed that the machined surface in the example included an insulation layer formed thereon, unlike the machined surface in the comparative example. Among the peaks in the example, there were peaks that completely did not match the peaks of $Fe_3O_4$ and $Fe_2O_3$. Such peaks are believed to be FeOOH and $Fe_5O_3(OH)_9$, which are hydroxides of iron. Furthermore, the presence of hydroxides was confirmed by Mossbauer spectrometry using gamma rays.

(Measurement of Surface Resistance)

Figure 12:
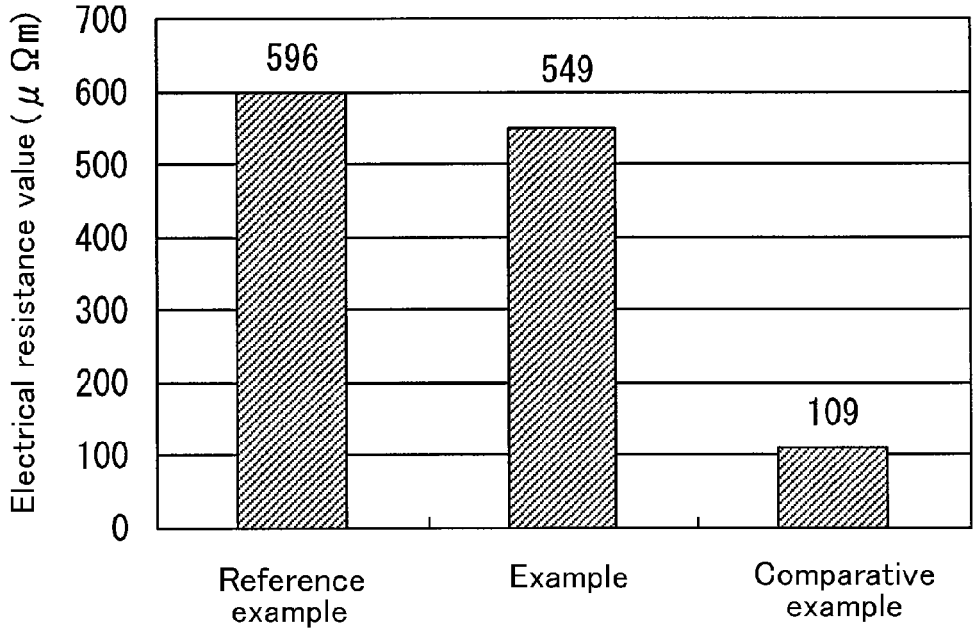
FIG. 12 is a graph showing the measurement results of a surface resistance of a heat-treated compact.

The surface resistance was measured by a four-terminal four-probe method using Resistivity meter Loresta GP manufactured by Dia Instruments Co., Ltd. FIG. 12 is a graph showing the results.

As is clear from the graph, the surface resistance of the machined surface in the example was substantially equal to that in the reference example in which grinding was not performed. Therefore, it is believed that the insulation between soft magnetic particles in the dust core produced in the example was almost the same as that in the reference example in which grinding was not performed. In contrast, the surface resistance of the machined surface in the comparative example was significantly decreased to about less than one-fifth the surface resistance in the reference example, which means that the insulation between soft magnetic particles is insufficient.

Example 2

Three dust cores were produced using the apparatus of the first embodiment in the same manner as in Example 1. In an example, a heat-treated compact was ground while a pulsed current was supplied. In a comparative example, a heat-treated compact was ground without supplying a pulsed current. In a reference example, grinding was not performed. Each of the cores was formed into a ring-shaped test piece, and the test piece was subjected to winding to obtain a measurement component. The magnetic properties of the measurement component were measured.

The machining conditions of the dust cores were as follows. After the grinding, an electric current was supplied for 30 seconds with a distance of 0.005 mm between the heat-treated compact and the grinding wheel.

Surface Grinding Conditions

Depth of cut: 10 μm, Total machined amount: 1.0 mm

Grinding Wheel

Abrasive grain: Material: cBN, Grain size: #200

Bond: cast iron

Additional element: Al 0.1% by mass, B 0.1% by mass

Heat-Treated Compact

Soft magnetic particles: pure iron (average particle size: 200 μm)

Insulation coating: phosphate film (inner insulation film)+silicone film (outer insulation film)

Supply Conditions of Electric Current

Pulsed voltage: 200 V

Average current: 10 A

The magnetic properties of the measurement component were measured using AC-BH Curve Tracer (manufactured by METRON, Inc.). The iron loss W1/10k at an excitation magnetic flux density Bm of 1 kG (=0.1 T) and a measurement frequency f of 10 kHz was determined. The frequency curve of iron loss was fitted by the least-squares method using the three formulae below to calculate the hysteresis loss coefficient Kh (mWs/kg) and the eddy-current loss coefficient Ke ($mWs^2/kg$) at the excitation magnetic flux density Bm. Table I shows the results. The values in Table I are relative evaluation values when the value in the reference example is assumed to be 100%. A low value means a low loss, which is preferred.

(Iron loss)=(Hysteresis loss)+(Eddy-current loss)

(Hysteresis loss)=(Hysteresis loss coefficient)×(Frequency)

(Eddy-current loss)=(Eddy-current loss coefficient)×(Frequency)

TABLE I

| | Iron loss W1/10 k (W/kg) | Hysteresis loss coefficient Kh (mWs/kg) (when Bm = 0.1 T) | Eddy-current loss coefficient Ke ($mWs^2/kg$) (when Bm = 0.1 T) |
|---|---|---|---|
| Reference example | 100% | 100% | 100% |
| Example | 105% | 108% | 104% |
| Comparative example | 147% | 116% | 166% |

As is clear from the results of Table I, the iron loss, in particular, the eddy-current loss in the example was significantly reduced compared with that in the comparative example. That is, it is believed that the insulation between soft magnetic particles is sufficiently ensured.

Example 3

As an example, the periphery of a columnar heat-treated compact was ground using the cylindrical grinder of the fifth embodiment. As a comparative example, grinding was performed on the same heat-treated compact under the same conditions without supplying a pulsed current. The surface resistance of the machined surface after grinding was measured, and ESCA (electron spectroscopy for chemical analysis) was performed in the depth direction from the machined surface. The surface resistance was measured using the same apparatus by the same method as in Example 1. The surface resistance was also measured on a heat-treated compact that was not subjected to grinding (reference example). In the ESCA, the element concentration was analyzed to a depth of 500 nm from the machined surface using Quantum 2000 manufactured by ULVAC-PHI, Inc. The grinding conditions were as follows. After the completion of grinding, an electric current was supplied for 60 seconds while holding a distance of 0.000 mm between a grinding wheel and the heat-treated compact, that is, holding a zero-cut state.

Periphery Grinding Conditions
- Infeed rate: 10 mm/min
- Machined amount: 1.0 mm (2.0 mm in diameter, outer diameter after machining: ϕ18 mm)

Grinding Wheel
- Abrasive grain: Material: cBN, Grain size: #120
- Bond: bronze
- Additional element: non Heat-Treated Compact
- Size and shape: round bar with ϕ20 mm
- Soft magnetic particles: pure iron (average particle size: 120 μm)
- Insulation coating: phosphate film Supply Conditions of Electric Current
- Pulsed voltage: 90 V
- Average current: 6 A As a result, the surface resistance in the reference example, which was an unprocessed heat-treated compact, was 750 μΩm on average whereas the surface resistance in the example was 7000 μΩm on average. The surface resistance in the comparative example was 120 μΩm on average. As is clear from the results, the surface resistance in the example was higher than that in the reference example, which was an unprocessed heat-treated compact. In contrast, the surface resistance in the comparative example was less than one-fifth the surface resistance in the reference example. It is assumed that the insulation coating of composite magnetic particles constituting the compact was damaged.

Figure 13:
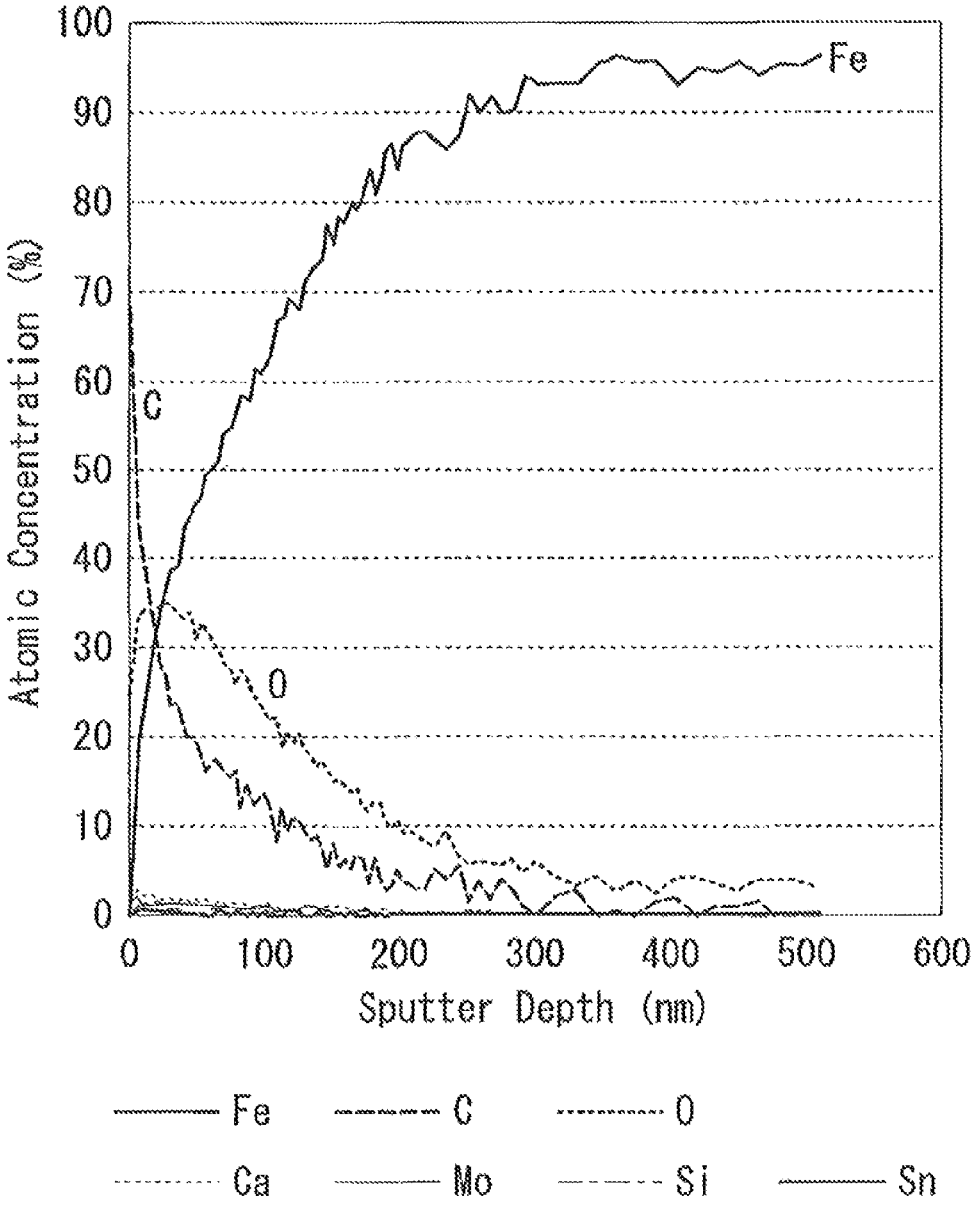
FIG. 13 is a graph showing the ESCA analysis results of a machined surface of a heat-treated compact formed by the method according to the fifth embodiment.

FIG. 13 shows the measurement results of ESCA in the example. As is clear from the graph, oxygen was detected in a range of about 200 nm, particularly about 100 nm, from the machined surface in the depth direction. Iron and its oxide, which were materials of soft magnetic particles, were confirmed to be present. It is also believed that Fe was present in the form of an oxide or a hydroxide from the energy state of a Fe peak (not shown). It is believed that the carbon found in this graph was incidental impurities during measurement. On the other hand, although the graph of the comparative example is not shown, peaks of elements other than iron and incidental impurities were not detected. Therefore, it is believed that a film composed of an oxide or hydroxide was not formed on the machined surface in the comparative example.

Example 4

As an example, the inner surface of a cylindrical heat-treated compact (workpiece) was ground using the internal grinder of the seventh embodiment. As a comparative example, grinding was performed on the same heat-treated compact under the same conditions without supplying a pulsed current. The surface resistance of the outer peripheral surface of the workpiece and the iron loss were measured. The outer peripheral surface of the heat-treated compact is not ground, but the insulation coating covering the soft magnetic particles is damaged when a compact before heat treatment is drawn from a mold. Therefore, a re-insulation coating step was performed to form a layer composed of at least one of an oxide and a hydroxide by supplying an electric current while a second counter electrode faces the periphery of the heat-treated compact. The surface resistance was measured using the same apparatus by the same method as in Example 1. The surface resistance was also measured on the outer peripheral surface of a heat-treated compact before the re-insulation coating step. The iron loss was measured by the same method as in Example 2. The grinding conditions were as follows. After the completion of grinding, an electric current was supplied for 180 seconds while holding a distance of 0.001 mm between a grinding wheel and the heat-treated compact and between the second counter electrode and the heat-treated compact.

Internal Grinding Conditions
- Infeed rate: 1 mm/min
- Machined amount: 1.0 mm (2.0 mm in diameter, inner diameter after machining: 35 mm)

Grinding Wheel
- Abrasive grain: Material: cBN, Grain size: #400
- Bond: steel
- Additional element: non Heat-Treated Compact
- Size and shape: hollow cylinder with ϕ50 mm, an inner diameter of 33 mm, and a height of 60 mm
- Soft magnetic particles: pure iron (average particle size: 50 μm)
- Insulation coating: titanate film Supply Conditions of Electric Current
- Pulsed voltage: 150 V
- Average current: 3 A As a result, the surface resistance of the heat-treated compact before the re-insulation coating step was 2100 μΩm on average whereas the surface resistance of the heat-treated compact after the re-insulation coating step was 10000 μΩm on average. As is clear from the results, by performing the re-insulation coating step, an insulation layer containing at least one of an oxide and a hydroxide of the constituent element of soft magnetic particles was formed on a portion where the insulation coating came off, and thus the surface resistance was higher than that of the heat-treated compact before the re-insulation coating step.

Table II shows the measurement results of iron loss. As is clear from Table II, the iron loss in the example was significantly reduced compared with that in the comparative example in which typical internal grinding was performed without supplying an electric current to a grinding wheel and also a second counter electrode was not disposed. In particular, the eddy-current loss was significantly reduced. It is also found that the loss in the example was as low as that in the reference example in which the internal grinding (re-insulation coating step) was not performed and compaction was performed after a lubricant was applied to the outer peripheral surface to prevent seizing caused by drawing from a mold.

TABLE II

| | Iron loss W1/10 kHz (W/kg) | Hysteresis loss coefficient Kh (mWs/kg) (when Bm = 0.1 T) | Eddy-current loss coefficient Ke ($mWs^2$/kg) (when Bm = 0.1 T) |
|---|---|---|---|
| Reference example | 100% | 100% | 100% |
| Example | 104% | 105% | 103% |
| Comparative example | 256% | 98% | 393% |

Examples 5 to 14

As an example, a heat-treated compact was ground or cut using the machining apparatus of each of the embodiments shown in Tables III to VI, and subsequently an electric current was supplied while holding a certain distance between the tool and the workpiece. The surface resistance of the machined surface of the workpiece after the current-supplying treatment was measured. The surface resistance was measured using the same apparatus by the same method as in Example 1. The result is expressed as the ratio of the surface resistance after machining to the surface resistance before machining (reference example). A ratio of more than 100% means that the surface resistance was improved compared with that before machining. The ratio is preferably 20% or more (⅕ or more of the surface resistance before machining) and more preferably 100% or more. The distance between the tool and the heat-treated compact after grinding (cutting) and the current-supplying conditions are shown in Tables. In the sixth embodiment, the internal grinding with a column-shaped grinding wheel has been described. The machining apparatuses used in Examples 13 and 14 shown in Tables V and VI are obtained by replacing the column-shaped grinding wheel with each of cutting tools.

TABLE III

| | Grinding wheel | | | | Heat-treated compact | | |
|---|---|---|---|---|---|---|---|
| Example No. | Abrasive grain | Grain size | Bond | Additive | Particle size (μm) | Soft magnetic particle | Insulation coating |
| Example 5 | cBN | 120 | Bronze | Non | 300 | Pure iron | Magnesia |
| Example 6 | Diamond | 800 | Vitrified | Non | 200 | Pure iron | Phosphate |
| Example 7 | cBN | 170 | Resin | Non | 30 | Fe—Si—Al | Silicate |
| Example 8 | Alumina | 80 | (Typical grinding wheel) | Non | 70 | Fe—Si | Silicone |
| Example 9 | Silicon carbide | 200 | (Typical grinding wheel) | Non | 150 | Pure iron | Phosphate |
| Example 10 | cBN | 200 | Nickel | Ti, Mg | 200 | Fe—Ni | Silicate |
| Example 11 | Diamond | 325 | Cast iron | Non | 250 | Pure iron | Phosphate |
| Example 12 | cBN | 120 | Bronze | Non | 350 | Pure iron | Magnesia |

TABLE IV

Figure 5:
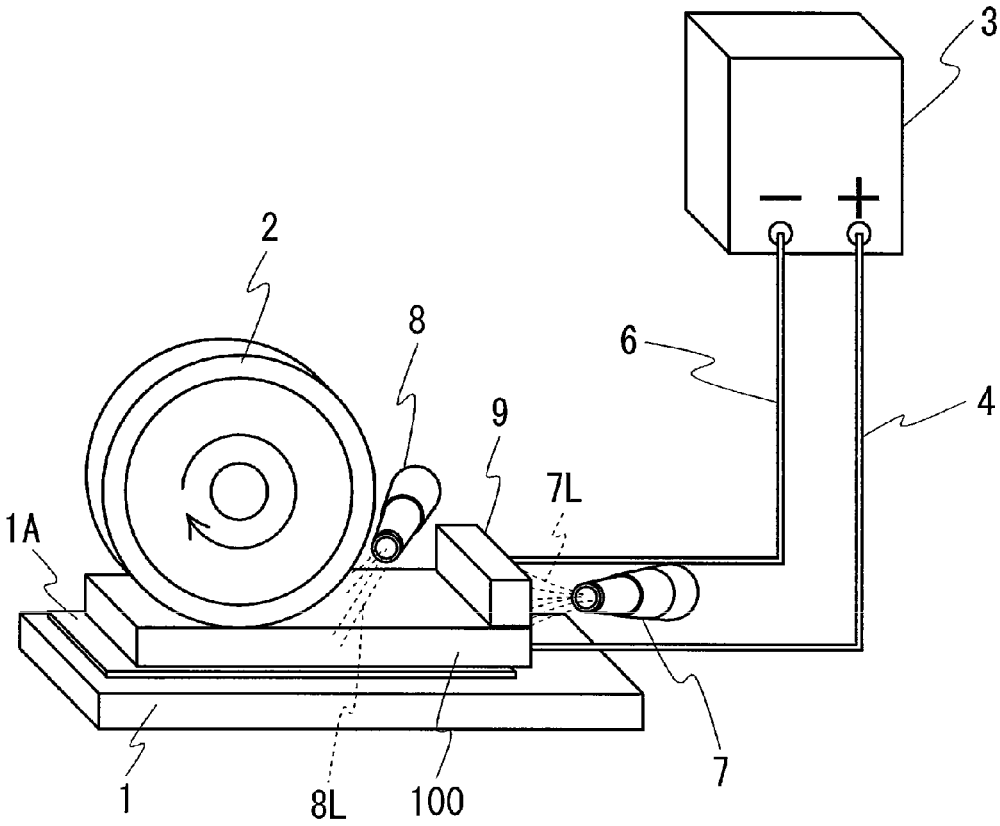
FIG. 5 is a schematic configuration diagram of an apparatus used to perform a method according to a third embodiment of the present invention.
Figure 6:
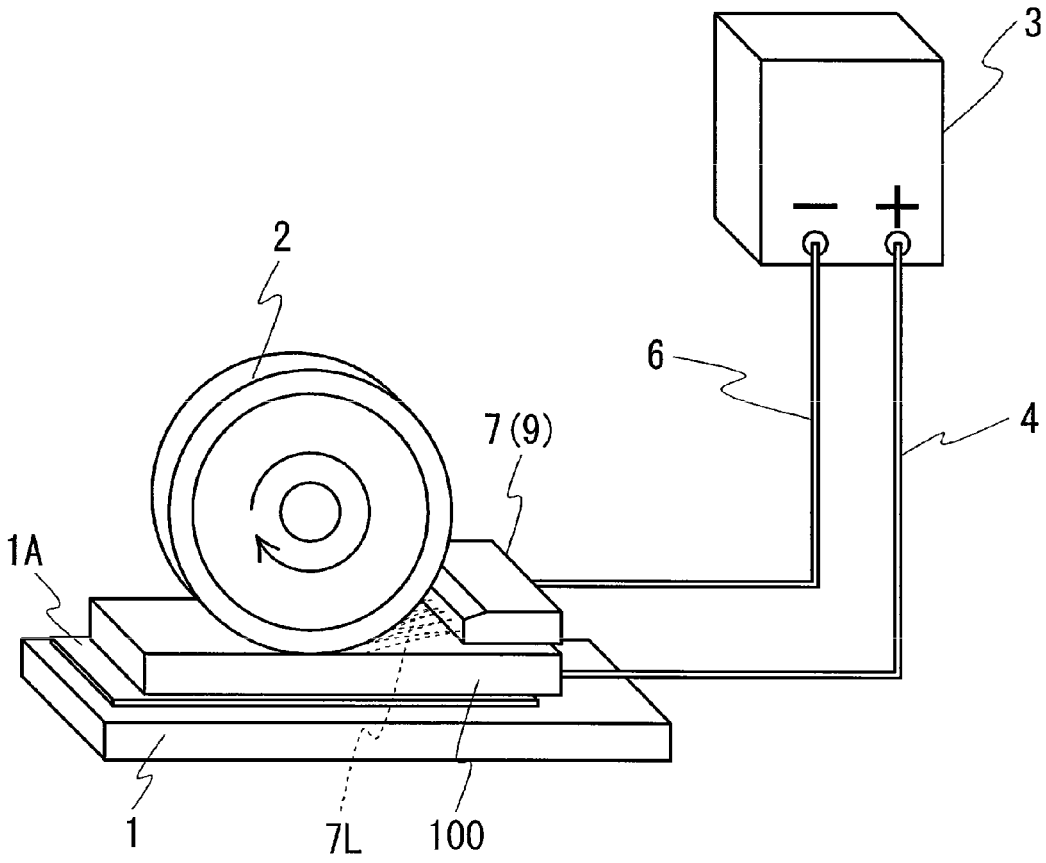
FIG. 6 is a schematic configuration diagram of an apparatus used to perform a method according to a fourth embodiment of the present invention.
Figure 7:
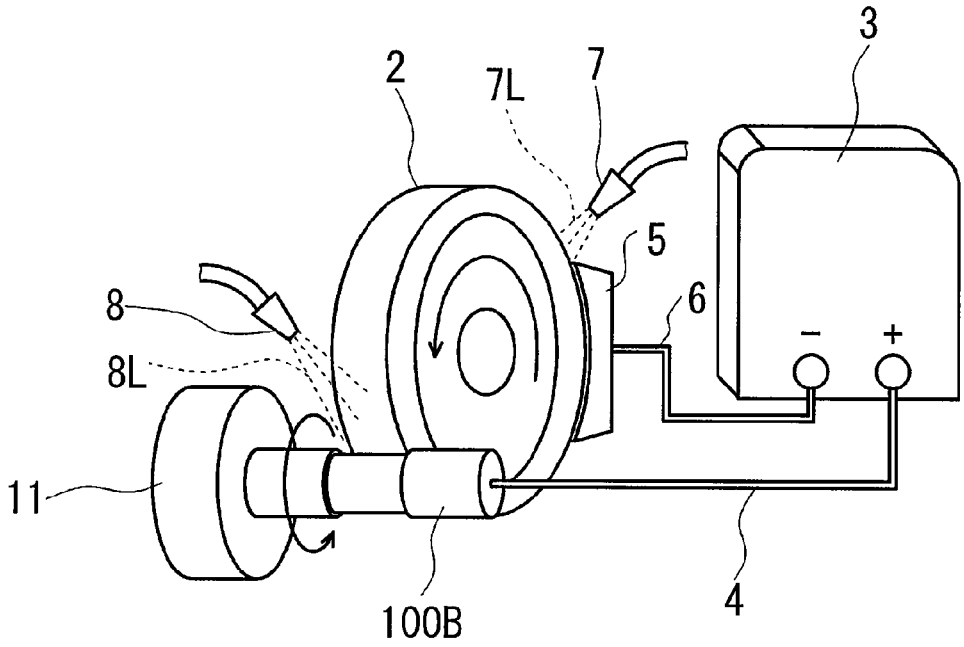
FIG. 7 is a schematic configuration diagram of an apparatus used to perform a method according to a fifth embodiment of the present invention.
Figure 8:
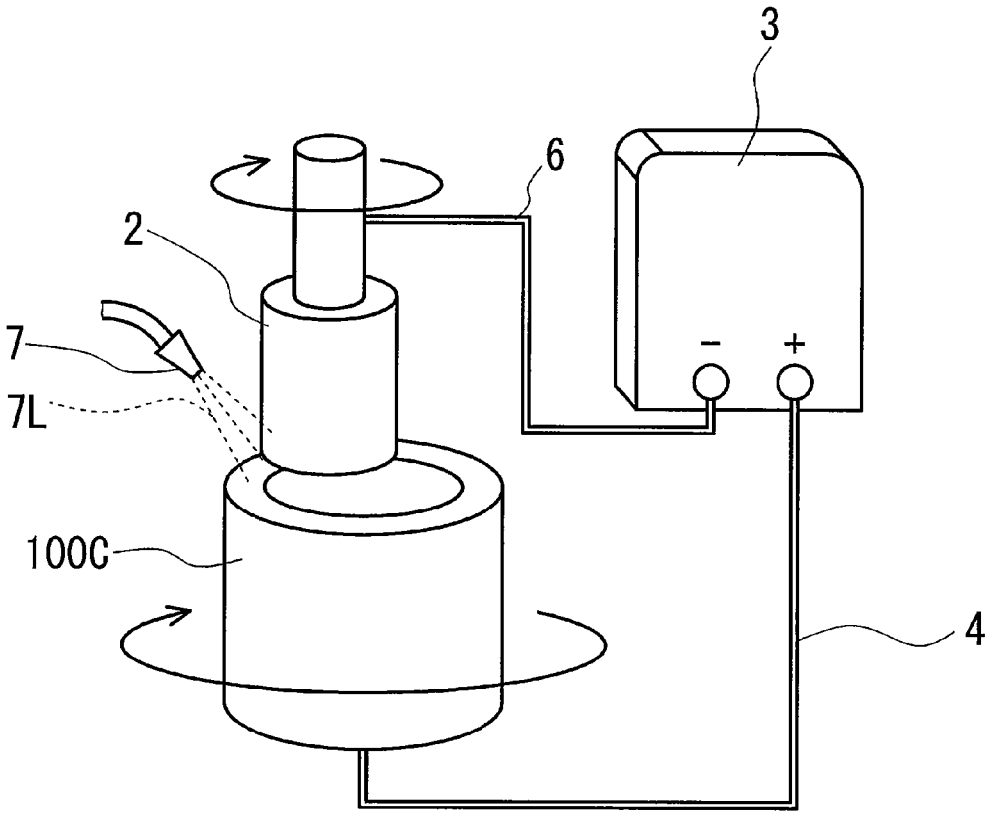
FIG. 8 is a schematic configuration diagram of an apparatus used to perform a method according to a sixth embodiment of the present invention.

| | Machining conditions | | | Supply of electric current | | | |
|---|---|---|---|---|---|---|---|
| | Embodiment | | Distance between anode and cathode (mm) | | Electric | | Surface |
| Example No. | Machining method | Corresponding drawing | | Voltage (V) | current (A) | Time (sec) | resistance (%) |
| Example 5 | Second embodiment Surface grinding | FIG. 4 | 0.002 | 150 | 20 | 10 | 65 |
| Example 6 | Third embodiment Surface grinding | FIG. 5 | 0.010 | 40 | 1 | 240 | 50 |
| Example 7 | Third embodiment Surface grinding | FIG. 5 | 0.010 | 200 | 0.5 | 100 | 97 |
| Example 8 | Third embodiment Surface grinding | FIG. 5 | 0.020 | 150 | 1 | 150 | 89 |
| Example 9 | Third embodiment Surface grinding | FIG. 5 | 0.010 | 90 | 4 | 60 | 105 |
| Example 10 | Fourth embodiment Surface grinding | FIG. 6 | 0.300 | 60 | 2 | 30 | 91 |
| Example 11 | Fifth embodiment Cylindrical grinding | FIG. 7 | 0.000 | 80 | 8 | 120 | 353 |
| Example 12 | Sixth embodiment Internal grinding | FIG. 8 | 0.100 | 90 | 1 | 150 | 78 |

TABLE V

| Example No. | Cutting tool | Heat-treated compact: Particle size (μm) | Soft magnetic particle | Insulation coating |
|---|---|---|---|---|
| Example 13 | Carbide tip | 150 | Pure iron | Phosphate |
| Example 14 | Carbide end mill | 150 | Pure iron | Phosphate |

TABLE VI

| Example No. | Machining conditions: Embodiment: Machining method | Corresponding drawing | Distance between anode and cathode (mm) | Supply of electric current: Voltage (V) | Electric current (A) | Time (sec) | Surface resistance (%) |
|---|---|---|---|---|---|---|---|
| Example 13 | Sixth embodiment Internal cutting | FIG. 8 | 0.001 | 40 | 12 | 10 | 32 |
| Example 14 | Sixth embodiment Internal cutting | FIG. 8 | 0.000 | 40 | 15 | 10 | 41 |

As is clear from the results above, the surface resistance in the example was higher than the surface resistance in the reference example, which was an unprocessed heat-treated compact, or the surface resistance higher than or equal to ⅕ (20%) of the surface resistance before machining was achieved. In particular, when the electric current is 4 A or more and the time is 60 seconds or longer, the ratio of the surface resistances easily exceeds 100%.

The above-described embodiments can be suitably modified without departing from the scope of the present invention and the scope of the present invention is not limited by the above-described embodiments. For example, the present invention can be applied to various grinders such as a centerless grinder, a profile grinder, a tool grinder, a thread grinder, a gear grinder, a free-form surface grinder, and a jig grinder, in addition to the grinders shown in the embodiments.

INDUSTRIAL APPLICABILITY

The dust core of the present invention can be suitably used as a dust core for, for example, electrical appliances equipped with solenoid valves, motors, or power supply circuits. The method for producing a dust core of the present invention can be suitably used in the field of producing similar dust cores.

REFERENCE SIGNS LIST

1 table
1A insulation sheet
2 working tool
3 power supply
4 anode wire
5 first counter electrode
6 cathode wire
6A, 6B branched wire
7 conductive fluid nozzle
7L conductive fluid
8 grinding fluid nozzle
8L grinding fluid
9 second counter electrode
11 insulation jig
100, 100B, 100C heat-treated compact
100P composite magnetic particle
100F machined surface
110 soft magnetic particle
120 insulation coating
130 insulation layer
110B bridge portion
200 toroidal core
300 coil
300*w* winding

The invention claimed is:

1. A dust core obtained by compacting soft magnetic particles having an insulation coating, the dust core comprising:

a machined surface on at least part of an outer peripheral surface of the core, the machined surface being formed by removing part of the core with a working tool, wherein soft magnetic particles that are adjacent to each other along the machined surface are isolated from each other through an insulation coating on the machined surface.

2. The dust core according to claim 1, wherein the machined surface is a surface formed by a process that includes supplying an electric current using a workpiece as an anode.

3. The dust core according to claim 2, wherein the machined surface includes an insulation layer containing at least one of an oxide and a hydroxide of a constituent element of the soft magnetic particles, and the insulation layer is formed through the supply of an electric current.

4. The dust core according to claim 2, wherein an insulation layer containing at least one of an oxide and a hydroxide of a constituent element of the soft magnetic particles is formed in a portion where the insulation coating has come off, the portion being present on the outer peripheral surface of the dust core other than the machined surface, and the insulation layer is formed through the supply of an electric current.

5. The dust core according to claim 3, wherein an electrical resistance value of a surface of the insulation layer is higher than or equal to ⅕ of an electrical resistance value of a surface of a heat-treated compact before machining.

6. The dust core according to claim 5, wherein the electrical resistance value of the surface of the insulation layer is higher than or equal to the electrical resistance value of the surface of the heat-treated compact before machining.

7. The dust core according to claim 3, wherein the electrical resistance value of the surface of the insulation layer is 150 μΩm or higher.

8. A coil component comprising:

the dust core according to claim 1; and a coil disposed on a periphery of the dust core.

* * * * *